US008801128B2

(12) United States Patent
Tsukamoto

(10) Patent No.: US 8,801,128 B2
(45) Date of Patent: Aug. 12, 2014

(54) DEVICE AND METHOD FOR DRIVING LIQUID DISCHARGE HEAD, LIQUID DISCHARGE APPARATUS, AND INK-JET APPARATUS

(71) Applicant: Fujifilm Corporation, Tokyo (JP)

(72) Inventor: Ryuji Tsukamoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 112 days.

(21) Appl. No.: 13/624,515

(22) Filed: Sep. 21, 2012

(65) Prior Publication Data

US 2013/0083106 A1 Apr. 4, 2013

(30) Foreign Application Priority Data

Sep. 30, 2011 (JP) ..... 2011-218698

(51) Int. Cl.
*B41J 29/38* (2006.01)

(52) U.S. Cl.
USPC ..... 347/10; 347/9; 347/11

(58) Field of Classification Search
USPC ..... 347/5, 9, 10, 11, 14
See application file for complete search history.

(56) References Cited

U.S. PATENT DOCUMENTS 6,715,852 B2 * 4/2004 Yonekubo ..... 347/10
7,611,214 B2 * 11/2009 Hosono et al. ..... 347/10

FOREIGN PATENT DOCUMENTS

JP 11-348320 A 12/1996
JP 2006-224471 A 8/2006

* cited by examiner

*Primary Examiner* — Lam S Nguyen
(74) *Attorney, Agent, or Firm* — Birch, Stewart, Kolasch & Birch, LLP

(57) ABSTRACT

A basic driving waveform which includes a plurality of jet pulses and a non-jet pulse just before the last jet pulse in one recording period is generated. A part of the pulses is removed from the basic driving waveform by maintaining at least the last jet pulse, and a driving signal that is applied to a discharge energy generation element is generated. In the case of using only the last jet pulse among the plurality of jet pulses is used for the jet, a first driving signal that includes the non-jet pulse just before the last jet pulse is generated. In the case of joining the last jet pulse and at least another jet pulse among the plurality of jet pulses to use the pulses for the jet, a second driving signal that is configured to remove the non-jet pulse is generated.

20 Claims, 12 Drawing Sheets

(FIG. 10 Continued)
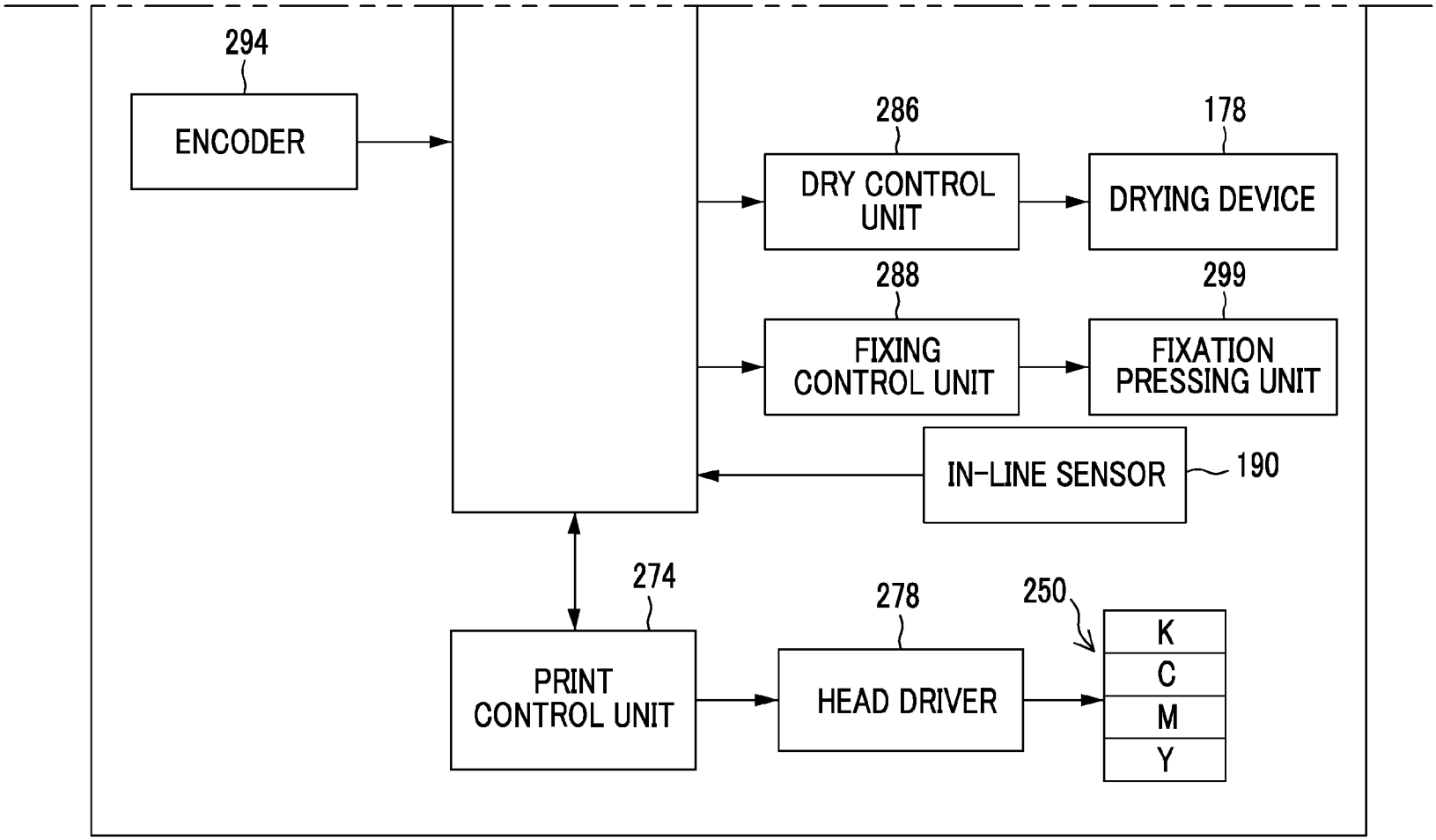

DEVICE AND METHOD FOR DRIVING LIQUID DISCHARGE HEAD, LIQUID DISCHARGE APPARATUS, AND INK-JET APPARATUS

BACKGROUND OF THE INVENTION

1. Field of the Invention

The present invention relates to a discharge control technique that performs landing with several kinds of dot sizes by changing the droplet quantity that particularly forms one dot in association with a device and a method for driving a liquid discharge head, a liquid discharge apparatus, and an ink-jet apparatus.

2. Description of the Related Art

In an ink-jet apparatus, a so-called multi-drop type gradation printing is known which changes the number of ink jet drops being jetted to 1, 2, 3, . . . with respect to printing data that corresponds to a record of one dot (landing point of one pixel) when recording an image by forming dots with ink drops on a recording medium such as paper or the like, and forms one-dot droplets by joining the plurality of ink drops (JP1999-348320A (JP-H 11-348320A) and JP-2006-224471A). By adopting this method, a high quality image can be formed.

In the multi-drop type gradation printing, there is a method in which the speed of an ink drop that is discharged later is sequentially set to be higher than the initial ink drop discharge, the ink drop that is discharged later reaches the preceding ink drop to join the preceding ink drop during their flight, and thus one droplet is landed on the recording medium (JP-2006-224471A). This method is realized by consecutively applying a driving pulse voltage to a piezoelectric actuator so that the amplitude of pressure waves in an ink chamber gradually increases during ink discharging.

JP1999-348320A (JP-H 11-348320A) discloses that a reference driving signal is made in which jet pulses the number of which is the maximum number of jets are arranged at predetermined time intervals, and a driving signal to be applied is made by removing a predetermined number of jet pulses sequentially from the front of the reference driving signal to acquire the dot gradation.

Further, JP-2006-224471A describes a technique to make the droplet speed between discharged ink drops constant through making different drop quantities in order to form dots having different sizes (large dot, medium dot, and small dot).

SUMMARY OF THE INVENTION

However, if the method that is described in JP1999-348320A (JP-H 11-348320A) is used, it is necessary to use a common jet pulse between ink drops having different dot sizes, and thus it is difficult to match the droplet speed between different ink drops. Because of this, the landing position of the droplet slips off due to different ink drop quantities, and as a result, a high-quality image is unable to be formed.

On the other hand, in the technique described in JP-2006-224471A, since the driving waveform (medium dot waveform, particularly see reference numeral P3 in FIG. 10C of JP-2006-224471A) for forming the medium dot is completely different from the driving waveform (see reference numeral P2 in FIG. 10B of JP-2006-224471A) for forming the small dot, the overall waveform becomes lengthened. Because of this, the recording period of one dot is lengthened, and the ink is unable to be discharged at a high frequency, thus lowering the productivity of a printer.

The present invention has been made in view of such situations, and an object of the invention is to provide a device for driving a liquid discharge head, a liquid discharge apparatus, and an ink-jet apparatus, which adopt a multi-drop method, secure high-precision in landing position through suppressing the difference in speed between discharge droplets due to different droplet quantities, and realize discharge at a high frequency.

According to an aspect of the present invention, a device for driving a liquid discharge head, which discharges droplets from a nozzle of a liquid discharge head by generating a driving signal for operating a discharge energy generation element that is provided in response to the nozzle and supplying the driving signal to the discharge energy generation element, includes a basic driving waveform generation unit generating a basic driving waveform including a plurality of jet pulses and a non-jet pulse just before the last jet pulse of the plurality of jet pulses in one recording period; and a driving signal generation unit removing a part of the pulses from the basic driving waveform by maintaining at least the last jet pulse and generating a driving signal that is applied to the discharge energy generation element, wherein the driving signal generation unit is provided with a waveform selection unit which can selectively generate a first driving signal that is configured by maintaining the last jet pulse of the plurality of jet pulses in the basic driving waveform and including the non-jet pulse just before the last jet pulse, and a second driving signal that is configured by maintaining the last jet pulse and at least another jet pulse of the plurality of jet pulses in the basic driving waveform and removing at least the non-jet pulse.

By removing the part of the plurality of waveform elements (pulses) that constitute the basic driving waveform, the driving signal is generated to be applied to the discharge energy generation element. The number of jets may be prescribed by the number of jet pulses included in the driving signal and the droplet quantity may be increased or decreased depending on the number of jets. The non-jet pulse is inserted between the last jet pulse located furthest backward and the jet pulse just before the last jet pulse of the plurality of jet pulses arranged in chronological order in the basic driving waveform.

When the last jet pulse is solely used for discharging, the non-jet pulse is applied to the discharge energy generation element in combination with the last jet pulse (first driving signal), and serves to adjust the speed of the droplet being discharged.

In the case of performing the discharge (jet) operation twice or more through combining the last jet pulse with another jet pulse, a second driving signal, from which the non-jet pulse has been removed, is applied to the discharge energy generation element. Through this, it becomes possible to match the speed of a droplet (first droplet quantity) that is discharged through application of the first driving signal and the speed of droplet due to another droplet quantity (second droplet quantity) that is discharged through application of the second driving signal. Further, since the basic driving waveform includes all the waveforms of the driving signals required to discharge various droplet quantities and the droplet quantities can be changed by the number of jet pulses extracted from the basic driving waveform, the length of the overall waveform can be shortened.

The "second driving signal" includes various driving signals having different numbers of jet pulses. If it is assumed that the number of jet pulses included in the basic driving waveform is N (where, N is an integer number that is equal to or larger than 2), (N−1) kinds of driving signals which have (N−1) jet pulses as the second driving signals may be supposed. The driving signal generation unit may adopt a configuration that can generate (N−1) kinds of driving signals in all or a configuration that can generate only some kinds of driving signals.

Other aspects of the present invention are clarified by the description in the specification and the drawings.

According to the present invention, since the multi-drop method is adopted and the deviation in speed between the discharge droplets by the different droplet quantities can be suppressed, the precision of the landing positions of the droplets can be improved. Further, the discharge at a high frequency can be realized. According to the present invention, a printer with both the high picture quality and the high productivity can be realized.

DESCRIPTION OF THE PREFERRED EMBODIMENTS

Hereinafter, embodiments of the present invention will be described in detail with reference to the accompanying drawings.

[Configuration of Liquid Discharge Apparatus]

Figure 1:
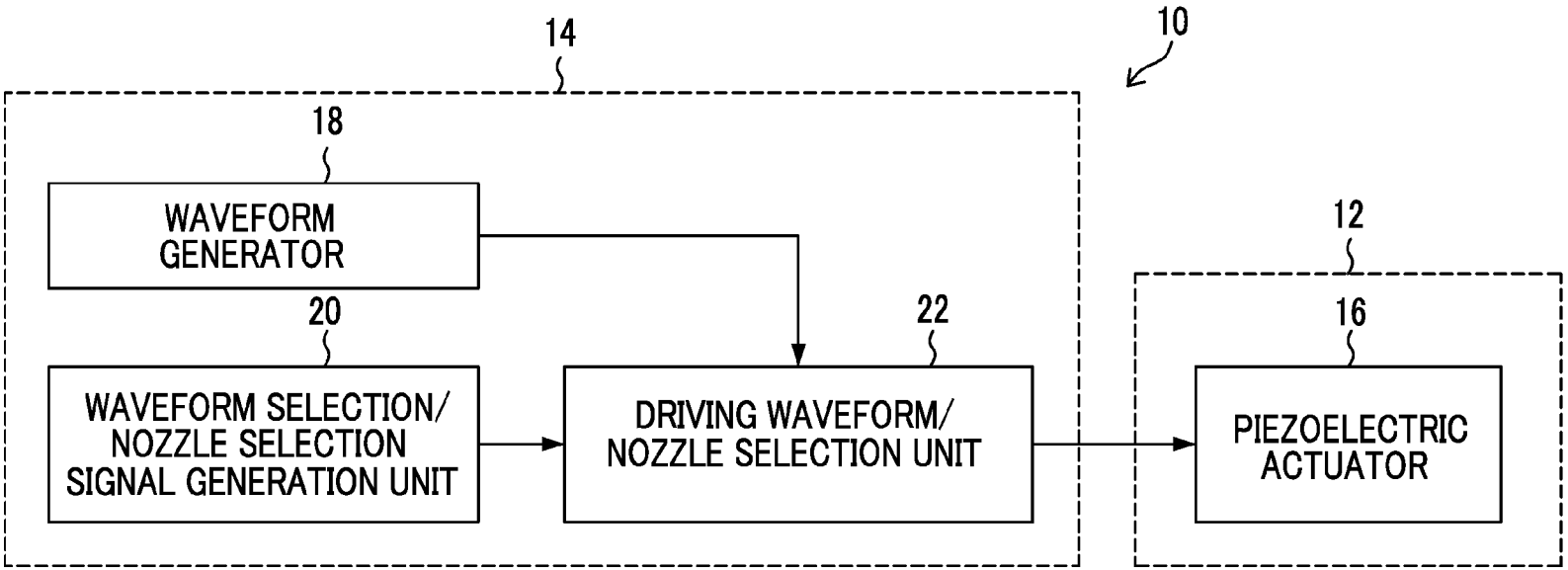
FIG. 1 is a block diagram illustrating the configuration of a liquid discharge apparatus using a device for driving a liquid discharge head according to an embodiment of the present invention.

FIG. 1 is a block diagram illustrating the configuration of a liquid discharge apparatus using a device for driving a liquid discharge head according to an embodiment of the present invention. A liquid discharge apparatus 10 according to this embodiment includes an ink-jet head 12 (corresponding to a "liquid discharge head") discharging droplet-shaped liquid (droplet) by an ink-jet method, and a driving device 14 supplying a driving signal to the ink-jet head 12 and controlling a discharge operation of the ink-jet head 12.

The ink-jet head 12 according to this embodiment adopts a piezoelectric driving type (piezojet type). That is, the ink-jet head 12 has a piezoelectric actuator 16 which is a pressurization source (discharge energy generation element) that generates discharge energy when discharging the droplet, and operates the piezoelectric actuator 16 according to the driving signal supplied from the driving device 14 to discharge the droplet through the nozzle. Although the details will be described later (see FIGS. 7A to 9), the ink-jet head 12 includes a nozzle that is a discharge port of the droplet, a pressure chamber that communicates with the nozzle, the piezoelectric actuator 16 that generates a discharge force through pressing the liquid in the pressure chamber, and a flow path for supplying the liquid to the pressure chamber.

The driving device 14 includes a waveform generator 18 generating a basic driving waveform that is the basis of the driving signal applied to the piezoelectric actuator 16, a signal generation unit 20 generating a nozzle selection signal for selecting a nozzle that discharges the droplet and a waveform selection signal depending on the droplet quantity (dot size) that is discharged from the nozzle, and a signal selection unit 22 which selects a signal that is applied to the corresponding piezoelectric actuator 16 to supply the driving signal depending on the droplet quantity from the basic driving waveform based on the waveform selection signal and the nozzle selection signal output from the signal generation unit 20.

The liquid discharge apparatus 10 according to this embodiment can form various dots having different droplet quantities through changing the driving waveform that is applied to the piezoelectric actuator 16. Here, it is exemplified that three kinds of dot sizes, that is, a small droplet, a medium droplet, and a large droplet, are configured to be droppable onto a recording medium (object to be landed). However, according to the present invention, the number of kinds of the droplet quantities (dot sizes) is not limited to three. The liquid discharge apparatus 10 may be configured to be able to form dots by an arbitrary number of kinds of droplet quantities that is equal to or larger than two.

Figure 3:
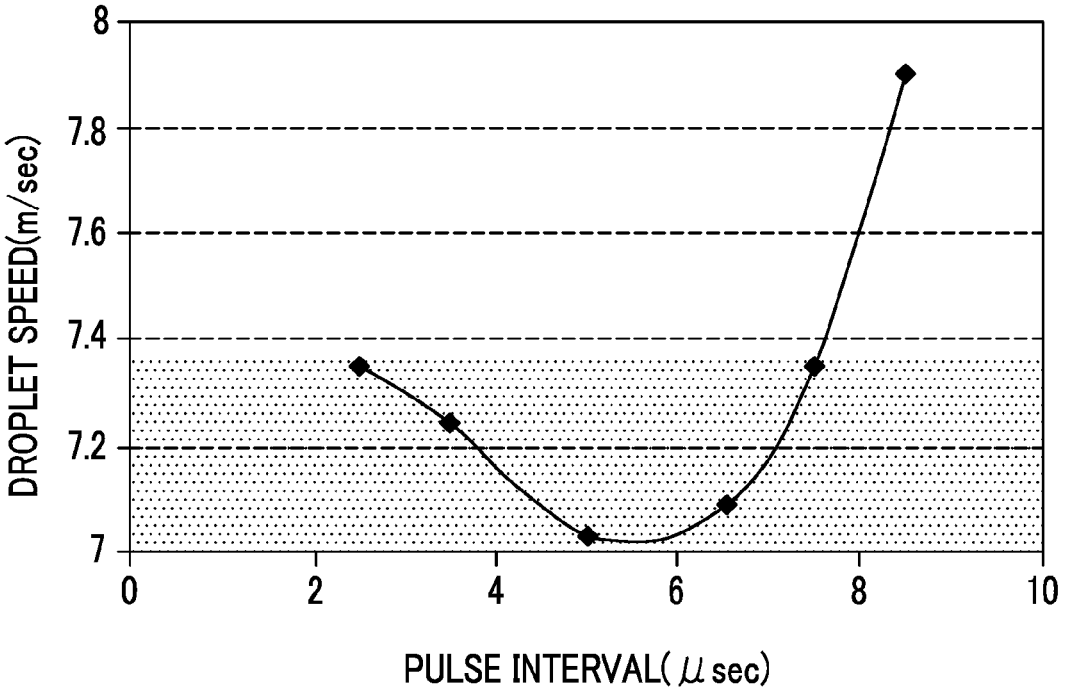
FIG. 3 is a graph illustrating a droplet speed of a small droplet with respect to an interval between the last jet pulse and a non-jet pulse.

The basic driving waveform generated by the waveform generator 18 includes all kinds of discharge driving waveforms of the small droplet, the medium droplet, and the large droplet, and by removing (or extracting) a part of the plurality of waveform elements that constitute the basic driving waveform, discharge driving waveforms of the respective kinds of droplets can be obtained (see FIG. 3).

The liquid discharge apparatus 10 according to this embodiment controls the application/non-application of the driving voltage to the piezoelectric actuator 16 through control of the signal selection unit 22 based on a nozzle selection signal and waveform selection signal that are sent from the signal generation unit 20 as a common basic driving waveform is supplied from the waveform generator 18 to the signal selection unit (for example, switch element) 22 that is connected to the piezoelectric actuator 16 provided to correspond to the plurality of nozzles. As described above, the nozzle to perform the discharge is selected, and a driving signal is applied only to the piezoelectric actuator 16 that corresponds to the selected nozzle according to the kind of droplet prescribed by the waveform selection signal.

In the case of forming a small-sized dot (small droplet) on a recording medium, a driving waveform for the small droplet is applied to the piezoelectric actuator 16, and in the case of forming a medium-sized dot, a driving waveform for the medium droplet is applied to the piezoelectric actuator 16.

Further, in the case of forming a large-sized dot (large droplet) on the recording medium, a driving waveform for the large droplet is output.

The ink-jet head 12 and the driving device 14 may be connected using a wiring member such as a flexible substrate as another configuration, or may be integrally connected to each other. Further, it is also possible to install a part of the driving device 14 (for example, a switch IC that functions as the signal selection unit 22) on the ink-jet head 12.

Explanation of Driving Signal

Figure 2A:
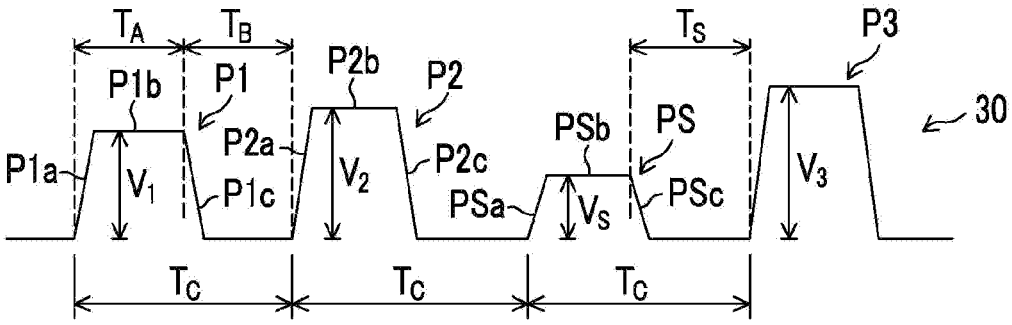
FIG. 2A is a waveform diagram of a basic driving waveform.

Next, the driving signal according to this embodiment will be described. FIG. 2A is a waveform diagram schematically illustrating one recording period of the basic driving waveform that is generated by the waveform generator 18 of FIG. 1. The horizontal axis represents time, and the vertical axis represents voltage. The basic driving waveform 30 includes a plurality of jet pulses P1, P2, and P3 and one non-jet pulse PS in one recording period that takes one-pixel dot record on the recording medium. The wording "one recording period" may be called "one typing period" or "one printing period" in the field concerned. Further, the wording "jet pulse" may be called "discharge pulse" or "pulse for discharge".

In this embodiment, the rising part of the pulses (P1 to P3 and PS) that constitute the basic driving waveform 30 operates (pulling) the piezoelectric actuator in the direction to draw meniscus into the nozzle (in the direction expanding the capacity of the pressure chamber), and the falling part operates (pushing) the piezoelectric actuator in the direction to push the meniscus out of the nozzle (in the direction contracting the pressure chamber).

The jet pulses P1, P2, and P3 are waveform elements for discharging the droplet from the nozzle by operating the piezoelectric actuator 16. Through the application of the respective jet pulses P1, P2, and P3, one discharge (jet) operation is performed. Although FIG. 2A shows an example in which three jet pulses P1, P2, and P3 are included, the number of jet pulses may be an arbitrary number that is equal to or larger than 2. The non-jet pulse PS is arranged just before the last (rearmost) jet pulse P3.

In the basic driving waveform 30, the front jet pulse (first jet pulse) P1 includes a first signal element P1*a* which performs the "pulling" operation that displaces the piezoelectric actuator in the direction to extend the volume of the pressure chamber communicating with the nozzle, a second signal element P1*b* that maintains (holds) the state where the pressure chamber is expanded by the pulling operation, and a third signal element P1*c* that performs the "pushing" operation that displaces the piezoelectric actuator in the direction to contract the pressure chamber.

The first signal element P1*a* is a rising waveform part that raises electric potential from the reference electric potential, the second signal element P1*b* is a waveform part that holds the electric potential $V_1$ that has been raised up to the first signal element P1*a*, and the third signal element P1*c* is a rising waveform part that raises electric potential $V_1$ of the second signal element P1*b* up to the reference potential.

The second jet pulse P2 that follows the first jet pulse P1, the non-jet pulse PS, and the third jet pulse (last jet pulse) P3 have signal elements that correspond to operations of "pulling", "holding", and "pushing". In the same manner as the signal elements P1*a*, P1*b*, and P1*c* as described with respect to the first jet pulse P1, by adding additional characters "a", "b", and "c" to the ends of the marks indicating the respective pulses, the respective signal elements of "pulling", "holding", and "pushing" are indicated.

In the description, for convenience in explanation, the potential difference (voltage) of the second signal elements P1*b* to P3*b* and PSb of the pulses P1 to P3 and PS with respect to the reference electric potential is called a "voltage amplitude" or "wave height".

Each jet pulse Pi (i=1, 2, and 3) has a trapezoidal shape, and the pulse width thereof (time $T_A$ from the rising timing of the jet pulse Pi to the falling timing thereof) is set to approximately ½ of a resonance period Tc of the ink-jet head 12. Further, the time interval (pulse period) from the rising start of the preceding pulse to the rising start of the following pulse is configured to accord to the integral multiple (one time in the same drawing) of the resonance period Tc. For example, if it is assumed that the resonance period Tc of the ink-jet head 12 according to this embodiment is about 10 μs, the pulse width $T_A$ of the jet pulse Pi is set to Tc/2=5 μs. Further, the time (pulse interval $T_B$) from the falling start of the first jet pulse P1 to the rising start of the second jet pulse P2 is also set to Tc/2=5 μs, and the time interval (period) from the rising start of the first jet pulse P1 to the rising start of the second jet pulse P2 is set to 10 μs. The pulse width of other pulses and the interval between adjacent pulses are set in the same manner.

However, in the embodiment of the present invention, it is not necessarily demanded to completely synchronize the pulse widths of the respective pulses and the pulse intervals. The pulse width of each pulse, the voltage, and the pulse interval are designed as far as the target droplet quantity and the droplet speed can be obtained by the number of jet pulses being applied.

The resonance period (Helmholtz period) Tc of the head means an inherent period of the overall vibration system that is determined by an ink flow path system, ink (acoustic element), the dimensions of the piezoelectric element, materials, and physical property values. The resonance period Tc may be found by calculation from the design value (including the physical property values of the ink being used) of the head. Further, the method is not limited to the estimation from the design value of the head, but may be a method for measuring Tc by experiments. For example, Tc may be measured by performing discharge with the changed pulse width or pulse period of the jet pulse, checking the droplet speed or droplet quantity, and finding the condition at which the maximum value can be obtained. Since the result of the measurement of Tc is uneven in a range that depends on the measurement method, during the identification of the resonance period Tc, it should be interpreted that the unevenness of the range, which depends on the difference in specific method being adopted, such as estimation (calculation) from the head design value or the measurement method, is permitted.

In the case of the piezojet type ink-jet head, a discharge mechanism of one nozzle has a structure in which a piezoelectric element is provided through a vibration plate in a pressure chamber that communicates with a nozzle hole (discharge port), the capacity of the pressure chamber is changed by displacing the vibration plate through driving of the piezoelectric element, and the discharge of droplet from the nozzle hole is performed by changing the pressure of the liquid in the pressure chamber. The meniscus in the nozzle forms a vibration system that vibrates in the resonance period Tc, and efficient discharge driving becomes possible by applying jet pulses to the piezoelectric element (piezoelectric actuator 16) to match the vibration period of the meniscus. That is, by making the timing of the movement of the meniscus that vibrates in the inherent vibration period and the timing of the pulling and pushing operation by the driving waveform match each other in the basic driving waveform 30, efficient discharge becomes possible.

Further, in the basic driving waveform 30 in FIGS. 2A to 2D, the voltage amplitudes (that mean the potential differences from the reference electric potential or wave height) of the jet pulses P1, P2, and P3 are set so that the later in terms of time they are, the greater they become. That is, as for the plurality of jet pulses P1, P2, and P3 that are arranged in chronological order in the basic driving waveform 30, the voltage of the following pulse is higher than the voltage of the chronologically preceding pulse. For example, based on the voltage $V_3$ of the last jet pulse P3, the voltage $V_1$ of the front jet pulse P1 is set to 65% of the voltage $V_3$ of the last jet pulse P3, and the voltage $V_2$ of the second jet pulse P2 is set to 75% of the voltage $V_3$.

The voltage $V_3$ of the last jet pulse P3 may be set to, for example, 80 V. Further, the discharge frequency may be set to, for example, 2 kHz. Here, the exemplified values of the voltage, the ratio of the voltage amplitude of the jet pulses, and the discharge period are merely exemplary, and in the embodiment of the present invention, various values may be set.

The non-jet pulse PS is positioned in front of the last jet pulse P3, that is, between the second jet pulse P2 and the third jet pulse P3. The interval between the non-jet pulse PS and the last jet pulse P3 (time interval Ts from the falling start of the non jet pulse PS to the rising start of the last jet pulse P3) is in a range that is equal to or larger than ¼ and equal to or smaller than ¾ of the head resonance period Tc.

The reason why the position of the non-jet pulse PS is in the range of $Tc/4 \leq Ts \leq Tc \times 3/4$ is that if the time interval Ts is smaller than ¼ of the resonance period Tc, the two pulses are too close to each other, and thus it is not possible to perform a normal jet by the last jet pulse P3. Further, if the time interval Ts exceeds ¾ of the resonance period Tc, the non-jet pulse PS becomes inefficient, and there is almost no effect (effect to control the droplet speed) due to the addition of the non-jet pulse PS (see FIG. 3).

The voltage amplitude (voltage $V_s$) of the non-jet pulse PS is appropriately set in a range that is equal to or higher than 10% and equal to or lower than 50% of the voltage $V_3$ of the rearmost jet pulse P3. The reason why the voltage $V_s$ of the non-jet pulse PS is set in this range is that if the voltage $V_s$ is lower than 10% of the voltage $V_3$, no effect appears (see FIG. 4), and if the voltage $V_s$ exceeds 50% of the voltage $V_3$, the droplet might be jetted from the nozzle by the application of the non-jet pulse PS.

By extracting a part of the basic driving waveform 30 shown in FIG. 2A, the driving waveform (FIG. 2B) for the small droplet, the driving waveform (FIG. 2C) for the medium droplet, and the driving waveform (FIG. 2C) for the large droplet can be obtained.

Figure 2B:
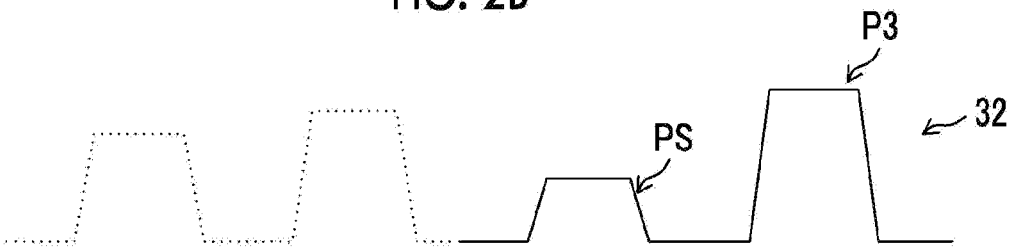
FIG. 2B is a waveform diagram illustrating a waveform (small droplet waveform) of a driving signal that is applied to a piezoelectric actuator during discharging of a small droplet.

FIG. 2B shows the driving waveform for the small droplet. In the case of forming the dot of the small droplet, only a portion that is indicated by solid line in FIG. 2B is applied to the piezoelectric actuator 16 through the signal selection unit 22. The waveform 32 of the small droplet is configured so that the first jet pulse P1 and the second jet pulse P2 are removed from the basic driving waveform 30 (FIG. 2A), and the non-jet pulse PS and the third jet pulse P3 remain as the residual waveform elements. That is, the waveform 32 of the small droplet is configured so that the first jet pulse P1 and the second jet pulse P2 are removed from the basic driving waveform 30, and the non-jet pulse PS and the third jet pulse P3 are extracted. By controlling the application timing of the signal to the piezoelectric actuator 16 by the waveform selection signal based on the driving signal of the basic driving waveform 30, the waveform indicated by solid line in FIG. 2B can be realized.

If the driving signal of the waveform 32 of the small droplet is applied to the piezoelectric actuator 16, the third jet pulse P3 is applied in a state where the meniscus is vibrated by the non-jet pulse PS, and one jet operation is performed by the third jet pulse P3 to discharge one droplet (small droplet) by the corresponding jet operation. This discharged droplet forms a dot of a small size (small dot) on the recording medium.

Figure 2C:
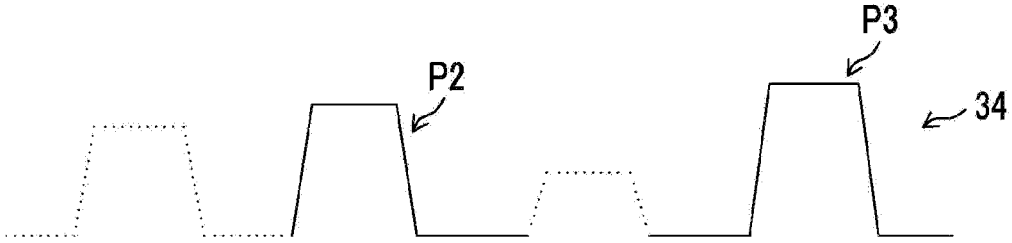
FIG. 2C is a waveform diagram illustrating a waveform (medium droplet waveform) of the driving signal that is applied to a piezoelectric actuator during discharging of a medium droplet.

FIG. 2C shows the driving waveform for the medium droplet. In the case of forming the dot of the medium droplet, only a portion that is indicated by solid line in FIG. 2C is applied to the piezoelectric actuator 16 through the signal selection unit 22. The waveform 34 of the medium droplet is configured so that the first jet pulse P1 and the non-jet pulse PS are removed from the basic driving waveform 30, and the second jet pulse P2 and the third jet pulse P3 remain as the residual waveform elements.

The waveform 34 of the medium droplet is obtained by extracting the second jet pulse P2 and the third jet pulse P3 from the basic driving waveform 30, and by controlling the application timing of the signal to the piezoelectric actuator by the waveform selection signal, the applied waveform indicated by solid line in FIG. 2C is realized.

If the driving signal of the waveform 34 of the medium droplet is applied to the piezoelectric actuator 16, the second jet pulse P2 and the third jet pulse P3 are consecutively applied, and thus the jet operation is performed twice to consecutively discharge two droplets.

The time interval from the starting end (rising start) of the second discharge pulse P2 to the starting end (rising start) of the third discharge pulse P3 becomes the integral multiple (here, twice) of the resonance period Tc. For vibration of the meniscus after the first jet by the second jet pulse P2, the third jet pulse P3 with the same phase is applied.

Since the voltage $V_3$ of the third jet pulse P3 is higher than the voltage $V_2$ of the second jet pulse P2 and the third jet pulse P3 is applied to amplify the meniscus vibration that is generated by the discharge operation once, the second droplet that is discharged by the third discharge pulse P3 has a higher speed than the first discharge droplet. As a result, the two droplets that are consecutively jetted are united into one droplet during their flight in the air, and then one droplet is landed on the recording medium to form medium-sized dot/intermediate-sized dot on the recording medium.

Figure 2D:
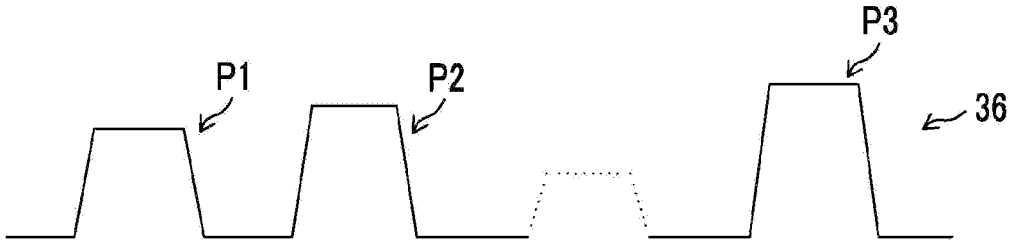
FIG. 2D is a waveform diagram illustrating a waveform (large droplet waveform) of the driving signal that is applied to a piezoelectric actuator during discharging of a large droplet.

FIG. 2D shows the driving waveform for the large droplet. In the case of forming the dot of the large droplet, only a portion that is indicated by solid line in FIG. 2D is applied to the piezoelectric actuator 16 through the signal selection unit 22. The waveform 36 of the large droplet is configured so that only the non-jet pulse PS is removed from the basic driving waveform 30, and the first jet pulse P1, the second jet pulse P2, and the third jet pulse P3 remain as the residual waveform elements.

The waveform 36 of the large droplet is obtained by extracting the first jet pulse P1, the second jet pulse P2, and the third jet pulse P3 from the basic driving waveform 30, and by controlling the application timing of the signal to the piezoelectric actuator by the waveform selection signal, the applied waveform indicated by solid line in FIG. 2D is realized.

If the driving signal of the waveform 36 of the large droplet is applied to the piezoelectric actuator 16, the first jet pulse P1, the second jet pulse P2, and the third jet pulse P3 are consecutively applied, and thus the jet operation is performed three times to consecutively discharge three droplets. The droplet that is discharged by the third jet pulse P3 has the highest speed, and the three droplets are united into one droplet during their flight, and then one droplet is landed on the recording medium to form a large-sized dot (large dot) on the recording medium.

As described above, since the driving waveform for forming the dot of the large droplet (waveform 36 of the large droplet in FIG. 2D) includes the jet pulses P2 and P3 that form the small droplet and the medium droplet, respectively, and the waveform 34 of the medium droplet (FIG. 2C) has a relationship to include the jet pulse P3 that forms the small droplet. The driving signal that is supplied to the piezoelectric actuator 16 through the signal selection unit 22 is sequentially selected from the later pulse in terms of time, among the plurality of jut pulses P1, P2, and P3 of the basic driving waveform 30, depending on the size of the dot to be formed on the recording medium. That is, the last jet pulse P3 is used to jet all kinds of droplets (large, medium, and small droplets).

As described with reference to FIGS. 2A to 2D, since at least the last jet pulse P3 remains to remove a part of the basic driving waveform 30, driving signals for discharging respective droplet quantities can be obtained, and the multi-drop type gradation printing in which the size of the jetted droplet is prescribed by the number of jet pulses included in the respective driving signals can be realized.

Regarding Roll of Non-Jet Pulse PS

In order to form one-dot droplet by uniting a plurality of ink drops that are consecutively discharged during their flight, it is necessary that the ink drop that is discharged from the rearmost (lastly) has the highest speed. Further, in the case of changing the droplet quantity through changing the number of jets (the number of jet pulses being applied), the rearmost jet pulse P3 is used for all waveforms of the small, medium, and large droplets in order to match a discharge timing of each droplet size.

Because of this, in the case of discharging the small droplet, only the rearmost jet pulse P3 among the basic driving waveforms 30 is used for the discharging. If the non-jet pulse PS is not added during the discharge of the small droplet, the droplet speed of the small droplet becomes excessively high in comparison to the droplet speeds of other medium and large droplets. That is, if the small droplet is discharged through applying only the jet pulse P3, the speed of the ink drop becomes high in comparison to the ink drop that is obtained by uniting a plurality of droplets such as the medium droplet and the large droplet. As a result, unevenness occurs in the landing positions between ink drops having different droplet sizes, and the drawing quality worsens.

In order to solve the unevenness of the landing positions due to the speed unevenness between droplets having different droplet quantities, the non-jet pulse PS is added only to the waveform (FIG. 2B) for jetting the smallest ink drop (small droplet). The non-jet pulse PS that is added just before the last jet pulse P3 serves to adjust the speed of the droplet (lower the speed) that is discharged through the application of the subsequent jet pulse P3 by vibrating the meniscus prior to the application of the jet pulse P3.

That is, if the discharge is performed by the jet pulse P3 in a state where the meniscus protrudes in the nozzle outside direction by the non-jet pulse PS, a part of ink protrusion at the nozzle outlet, so to speak, acts like an obstacle, and hinders liquid pushed out of a pressure chamber from going forward. Through this, in comparison to the droplet speed in the case where the small droplet is discharged through applying only the jet pulse P3 without adding the non-jet pulse PS, the speed of the small droplet that is discharged with application of the waveform 32 of the small droplet becomes slow. By adjusting the voltage Vs of the non-jet pulse PS and the pulse application timing, it becomes possible to control the droplet speed of the small droplet and to match the droplet speed of the small droplet to the droplet speed of the medium droplet and the large droplet.

FIG. 3 is a graph illustrating the result of experiments to examine the droplet speed of a small droplet when the interval (Ts) between the last jet pulse and the non-jet pulse is changed. The horizontal axis represents a pulse interval Ts (the unit is μs) between the last jet pulse and the non-jet pulse, and the vertical axis represents a droplet speed.

When a medium droplet and a large droplet were discharged using the waveforms illustrated in FIGS. 2C and 2D using an ink-jet head having a head resonance period of 10 μs, the discharge speeds of the medium droplet and the large droplet were almost equal to each other, and were 7.0 m/s. That is, the voltage amplitudes or the pulse widths of the jet pulses P1, P2, and P3 are adjusted so that the speeds of the medium droplet and the large droplet became constant, and became 7.0 m/s.

Further, by adding the non-jet pulse PS of 25% of the voltage ($Vs=0.25\times V_3$) just before the last jet pulse P3 of the adjusted voltage $V_3$, the interval between these two pulses was changed to examine the discharge speed of the small droplet. Further, the head resonance period is 10 μs, and the voltage of the last jet pulse P3 is $V_3=80V$.

As a result, as shown in FIG. 3, when the position of the non-jet pulse PS is in a range of 7.5 μs from 2.5 μs just before the last jet pulse P3, the difference between the droplet speeds of the large droplet and the medium droplet is within +5% that is the preferable range. In FIG. 3, the range of the droplet speed of the small droplet was set to +5%, that is, 7.0 to 7.35 m/s, as a permissible range as highlighted in the drawing.

Based on the result shown in FIG. 3, the relationship between the voltage ratio of the non-jet pulse PS (the ratio of voltage Vs of the non-jet pulse PS to voltage $V_3$ of the last jet pulse P3 ($Vs/V_3$)) and the droplet speed when the interval (Ts) between the last jet pulse P3 and the non-jet pulse PS was set to 5 μs was examined. The result is shown in FIG. 4.

Figure 4:
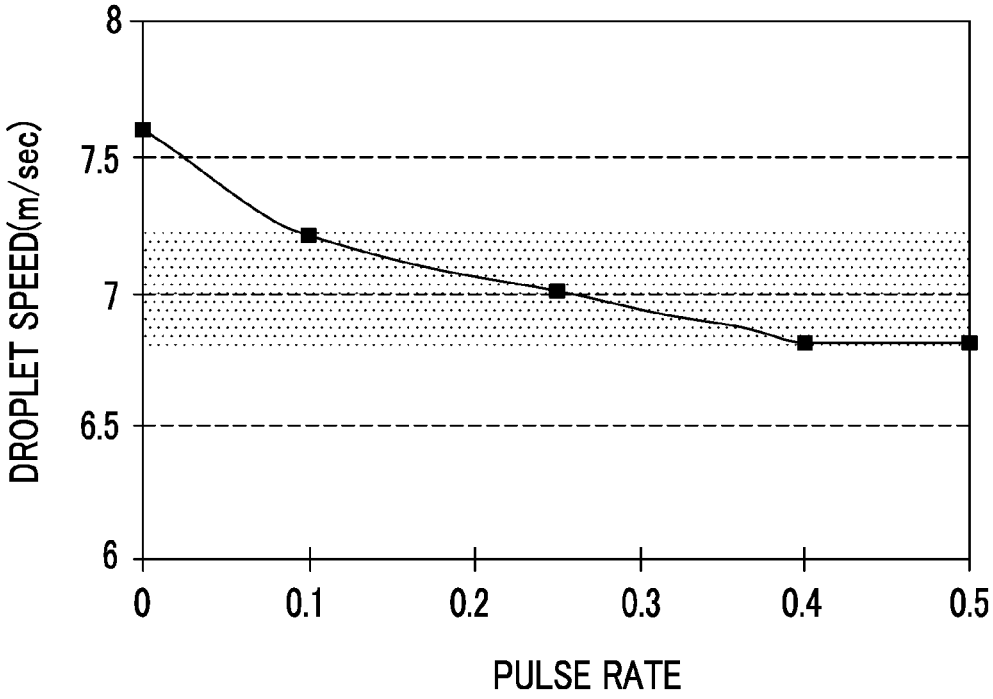
FIG. 4 is a graph illustrating the relationship between the ratio of a non-jet pulse voltage to the last jet pulse voltage and a small droplet speed.

As shown in FIG. 4, by setting the voltage Vs of the non-jet pulse PS to the range of 10% to 50% of the voltage $V_3$ of the last jet pulse P3, the difference between the droplet speeds of the large droplet and the medium droplet (7.0 m/s) and the droplet speed of the small droplet was ±2.5% that was the preferable range. In FIG. 4, the range of the droplet speed of the small droplet was set to 7.0 m/s±2.5%, as a permissible range as highlighted in the drawing.

As described above, according to this embodiment, unevenness of the droplet speed due to the difference between the droplet sizes can be reduced. Through this, high landing position accuracy can be secured and thus high-resolution imaging becomes possible. Further, according to this embodiment, since the jet pulse (last jet pulse P3) for discharging the minimum droplet (small droplet) is necessarily included in the waveform for discharging other droplet quantities (medium droplet and large droplet), and the driving waveform that is used to discharge the droplet having a relatively large droplet quantity includes all the jet pulses included in the driving waveform that is used to discharge the droplet having a relatively small droplet quantity, it is not necessary to match an individual jet pulse for each droplet size. Accordingly, the length of the driving waveform that realizes the discharge of plural kinds of droplets having different droplet sizes can be relatively shortened. As a result, high-frequency discharge becomes possible.

Modified Example 1

It is also possible to provide a configuration that adds a reverberation restraint pulse (which may be called a meniscus correction unit or a reverberation restraint unit) for restraining the reverberation of the meniscus after discharging just after the last jet pulse P3 in the basic driving waveform 30 illustrated in FIG. 2A. In this case, the reverberation restraint pulse can be added to the driving waveform for discharging each of the droplets of the small droplet, the medium droplet, and the large droplet.

By combining the reverberation restraint pulse, the discharge efficiency of the last pulse can be further improved, and the meniscus vibration (reverberation) after discharging one recording period can be reduced to be able to seek the stabilization of consecutive recording.

Modified Example 2

Although it is exemplified that the driving waveforms illustrated in FIGS. 2A to 2D are configured to draw the meniscus into the pressure chamber direction through making the pressure chamber expand by a rising portion of the pulse to raise the voltage in the plus direction from the reference potential, it is also possible to adopt a configuration which performs a "pulling" operation for drawing the meniscus through making the pressure chamber expand by a falling portion of the pulse that lowers the voltage from the reference potential, and performs a "pushing" operation through contracting the pressure chamber by a rising portion to raise the voltage from the lowered voltage.

Regarding Kinds of Droplet Sizes

Although it has been described that three kinds of droplets, that is, the small, medium, and large droplets, are provided, the kinds of droplets can be generalized as follows. That is, it is possible to perform discharge with different droplet quantities by selecting K (where, K is an integer that is equal to or larger than "1" and equal to or smaller than M) jet pulses from behind among the basic driving waveforms including M jet pulses and supplying the K jet pulses to the discharge energy generation element during one recording period. In this case, among M jet pulses, the non-jet pulse PS is arranged between the last jet pulse (M-th jet pulse) and the jet pulse just before one jet pulse ((M−1)-th jet pulse).

In the case of applying such driving waveforms to an actual ink-jet apparatus, the basic driving waveform data (waveform data that corresponds to the droplet kind of the maximum droplet quantity) that includes waveforms of the whole droplet kinds is put in a storage unit such as a memory, and information of the end what number of the pulse assumes the front-end pulse during application for each droplet kind is maintained. By selecting the pulse from behind among the basic waveform (waveform of the maximum droplet quantity) composed of the plurality of pulses including the waveforms of all the droplet kinds, it becomes possible to divide the droplet kinds.

In the case of discharging the minimum droplet using only the last (M-th) jet pulse as a jet pulse, adjustment of the droplet speed is made through application of the non-jet pulse PS before the last jet pulse. On the other hand, in the case of discharging the droplet having a droplet quantity larger than the minimum droplet (in the case of including two or more jet pulses in the driving signal of one recording period) using a jet pulse except for the last jet pulse as the jet pulse, the application of the non-jet pulse is omitted.

The pulse (waveform element) that is applied to the piezoelectric actuator 16 may be selected by controlling ON/OFF operation of a switching element that is provided on a signal transfer line for applying a driving signal to, for example, the piezoelectric actuator 16 (discharge energy generation element), as means for obtaining the waveform that corresponds to a desired droplet quantity, with removal of a part of the basic driving waveform. Through this, using the switch element provided corresponding to each piezoelectric actuator 16, the driving voltage of the waveform that corresponds to each kind of droplet is applied to the piezoelectric actuator 16.

Configuration Example of Ink-Jet Recording Device

Figure 5:
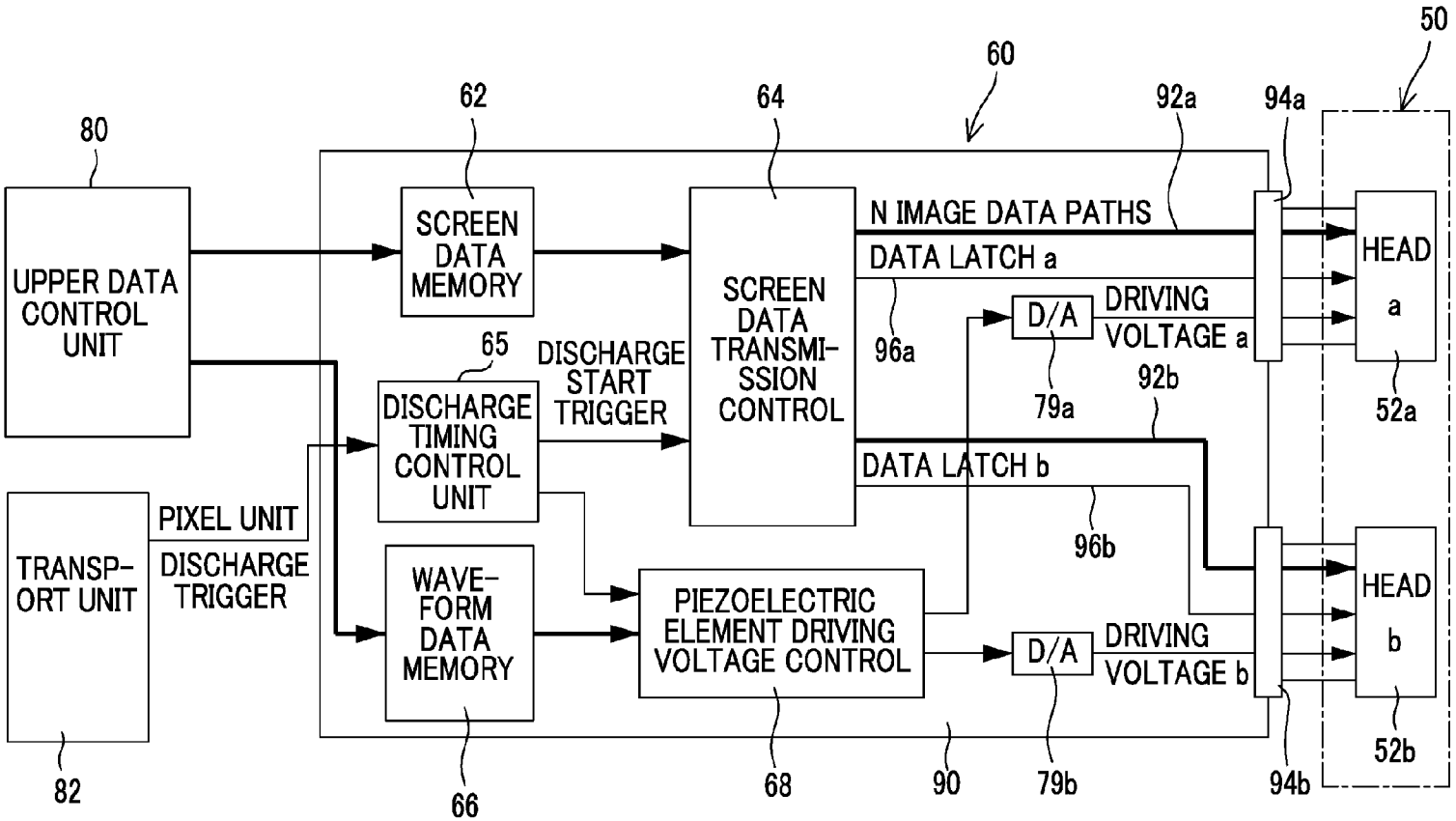
FIG. 5 is a block diagram illustrating the configuration example of an ink-jet recording device to which a liquid discharge head driving device according to an embodiment of the present invention is applied.

FIG. 5 is a block diagram illustrating the configuration example of an ink-jet recording device to which a liquid discharge head driving device according to an embodiment of the present invention is applied. A print head (corresponding to a "liquid discharge head") 50 is configured by combining a plurality of ink-jet head modules (hereinafter referred to as "head modules") 52*a* and 52*b*. Here, in order to simplify explanation, two head modules 52*a* and 52*b* are illustrated. However, the number of head modules that constitute one print head 50 is not specially limited.

Although the detailed configuration of the head modules 52*a* and 52*b* is not illustrated, a plurality of nozzles (ink discharge port) are two-dimensionally arranged at high density on ink discharge surfaces of the head modules 52*a* and 52*b*. Further, on the head modules 52*a* and 52*b*, discharge energy generation elements (in this embodiment, piezoelectric elements) corresponding to the respective nozzles are provided.

By connecting the plurality of head modules 52*a* and 52*b* with respect to the width direction of a paper (not illustrated) as a drawing medium, long-length line heads (page wide heads where single pass printing is possible) having a nozzle line (row) which is able to draw at a predetermined recording resolution (for example, 1200 dpi) with respect to all recordable range (whole area of the drawable width) in the paper width direction are configured.

A head control unit 60 (corresponding to a "liquid discharge head driving device") that is connected to the print head 50 functions as a control unit for controlling the discharge operation (whether to discharge, and droplet discharge quantity) of ink from the nozzles through controlling the driving of the piezoelectric elements that correspond to the respective nozzles of the plurality of head modules 52*a* and 52*b*.

The head control unit 60 includes an image data memory 62, an image data transfer control circuit 64, a discharge timing control unit 65, a waveform data memory 66, a driving voltage control circuit 68, and D/A converters 79*a* and 79*b*. In this embodiment, the image data transfer control circuit 64 includes a "latch signal transmission circuit", and a data latch signal is output from the image data transfer control circuit 64 to the respective head modules 52*a* and 52*b* in an appropriate timing.

Image data that is developed in image data for print (dot data) is stored in the image data memory 62. Digital data that indicates the voltage waveform (driving waveform) of the driving signal for operating the piezoelectric element is stored in the waveform data memory 66. For example, data of the basic driving waveform illustrated in FIG. 2A and data that indicates an end of the pulse are stored in the waveform data memory 66. The waveform data memory 66 is an element that is included in the waveform generator 18 illustrated in FIG. 1, and corresponds to the "basic driving waveform generation unit".

The image data input to the image data memory 62 and the waveform data input to the waveform data memory 66 are managed by an upper data control unit 80 (corresponding to an "upper control device"). The upper data control unit 80, may be configured by, for example, a PC or a host computer. The head control unit 60 is a data communication unit for receiving data from the upper data control unit 80, and is provided with a USB (Universal Serial Bus) and other communication interfaces.

In FIG. 5, for simplicity in explanation, only one print head 50 (for one color) is illustrated. In the case of an ink-jet recording device having a plurality of print heads (by colors) that correspond to a plurality of ink colors, however, the head control unit 60 is provided for each color print head 50 individually (in the unit of a head). For example, in the configuration having color print heads that correspond to four colors of cyan (C), magenta (M), yellow (Y), and black (K), the head control unit 60 is installed for each of the color print heads of CMYK, and the respective color head control units are managed by one upper data control unit 80.

At the time of system start, waveform data or image data are transferred from the upper data control unit 80 to the respective color head control units 60. Further, the image data may be transferred in synchronization with paper transportation during printing execution. Further, during the printing operation, the respective color discharge timing control units 65 receive a discharge trigger signal from a paper transport unit 82, and output a start trigger for starting the discharge operation to the image data transfer control circuit 64 and the driving voltage control circuit 68. The image data transfer control circuit 64 and the driving voltage control circuit 68 receive the start trigger, perform transfer of the waveform data and the image data in the unit of resolution to the head modules 52*a* and 52*b*, and perform a selective discharge operation (discharge driving control of a drop-on demand) in response to the image data to realize page wide printing.

The driving voltage waveform data is output from the driving voltage control circuit 68 to the D/A converters 79*a* and 79*b* in accordance with a print timing signal input from the outside, and is converted into an analog voltage waveform by the D/A converters 79*a* and 79*b*. The output waveform (analog voltage waveform) of the D/A converters 79*a* and 79*b* is amplified to predetermined current and voltage that are suitable for the driving of the piezoelectric element by an amplification circuit (power amplification circuit) (not illustrated), and then is supplied to the head modules 52*a* and 52*b*.

The image data transfer control circuit 64 may be configured by a CPU (Central Processing Unit) or FPGA (Field Programmable Gate Array). The image data transfer control circuit 64 controls transfer of nozzle control data (here, image data corresponding to a dot arrangement of record resolution) of the respective head modules 52*a* and 52*b* to the respective head modules 52*a* and 52*b* based on the data stored in the image data memory 62. The nozzle control data is image data (dot data) that determines the ON (discharge driving)/OFF (non-driving) operation of the nozzle. The image data transfer control circuit 64 transfers the nozzle control data to the respective head modules 52*a* and 52*b* to control the ON/OFF operation of each nozzle.

Image data transfer paths 92*a* and 92*b* for transferring the nozzle control data output from the image data transfer control circuit 64 to the respective head modules 52*a* and 52*b* are composed of a plurality of signal lines (n signal lines, n≥2) that are called "image data buses", "data buses", or "image buses". In this embodiment, the image data transfer paths are hereinafter called "data buses" 92*a* and 92*b*. One end of the data bus 92*a* or 92*b* is connected to an output terminal (IC pin) of the image data transfer control circuit 64, and the other end thereof is connected to the head modules 52*a* and 52*b* through connectors 94*a* and 94*b* that correspond to the respective head modules 52*a* and 52*b*.

The data buses 92*a* and 92*b* may be configured by a copper line pattern of an electrical circuit board 90 on which the image data transfer control circuit 64 and the driving voltage control circuit 68 are mounted, wire harness, or a combination thereof.

The signal lines 96*a* and 96*b* of the data latch signal that correspond to the respective head module 52*a* and 52*b* are installed for each head module 52*a* or 52*b*. The data latch signal is transmitted from the image data transfer control circuit 64 to the respective head modules 52*a* and 52*b* in a necessary timing in order to set the data signal transferred through the data buses 92*a* and 92*b* as the nozzle data of the respective head modules 52*a* and 52*b*. At a time when a predetermined amount of image data is transmitted from the image data transfer control circuit 64 to the head modules 52*a* and 52*b* through the image data buses 92*a* and 92*b*, a signal (latch signal) that is called a data latch is transmitted to the head modules 52*a* and 52*b*. In the timing of this data latch signal, data of the ON/OFF setting of the displacement of the piezoelectric element in each module is established. Thereafter, by applying driving voltages a and b to the head modules 52*a* and 52*b*, the piezoelectric element that is related to the ON setting is minutely displaced to discharge the ink drops. By attaching (landing) the ink drops discharged as above onto the paper, printing with a desired resolution (for example, 1200 dpi) is performed. Further, the piezoelectric element that has been set to the OFF state does not make displacement even if the driving voltage is applied thereto, and thus the droplet is not discharged.

A combination of the waveform data memory 66, the driving voltage control circuit 68, the D/A converter 79*a* and 79*b*, and the switch element (not illustrated) for newly changing the operation/non-operation of the piezoelectric element that corresponds to each nozzle corresponds to the "driving signal generation unit".

Figure 6:
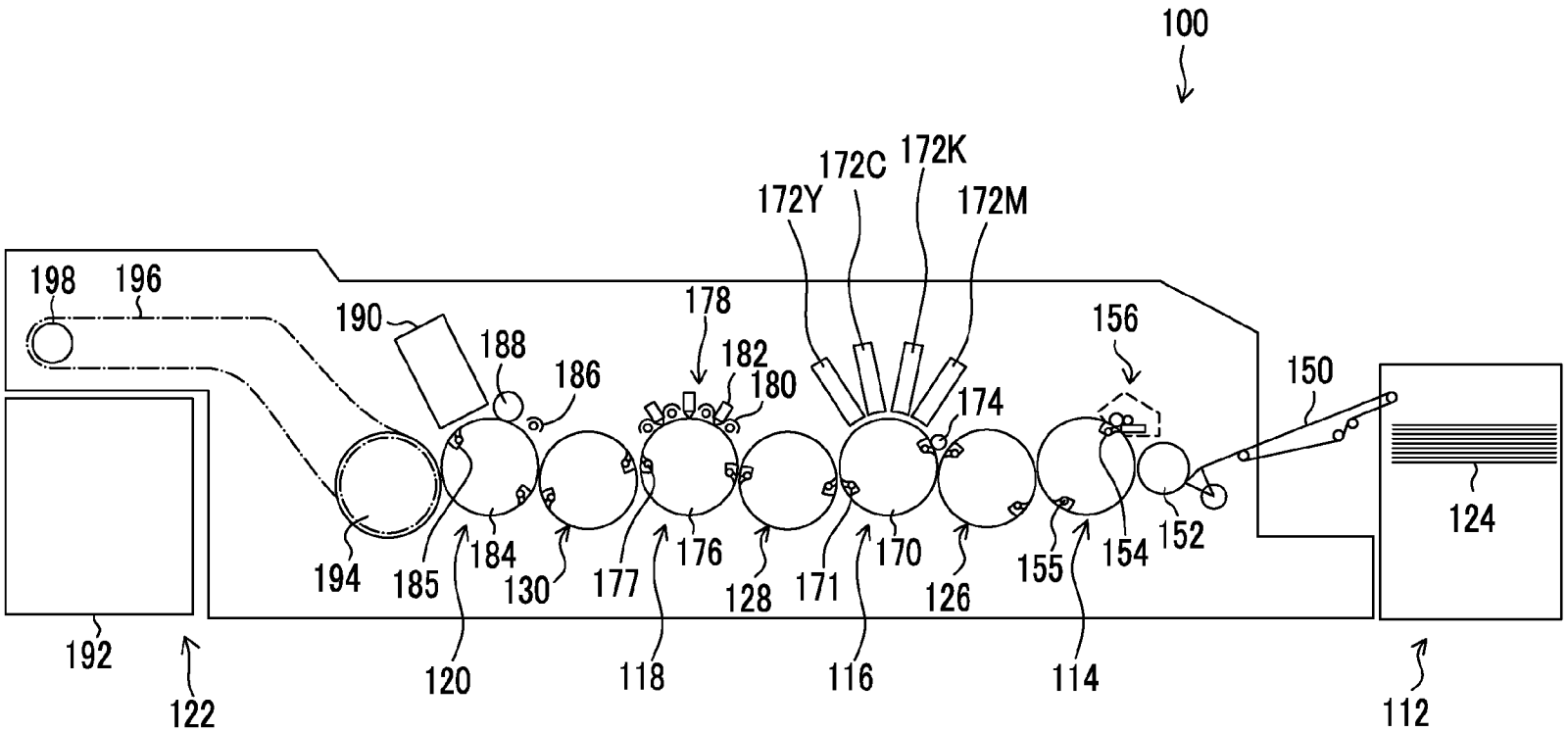
FIG. 6 is a view illustrating the overall configuration of an ink-jet recording device according to an embodiment of the present invention.

FIG. 6 is a view illustrating the overall configuration of an ink-jet recording device according to an embodiment of the present invention. An ink-jet recording device 100 according to this embodiment mainly includes a feed unit 112, a processing solution grant unit (pre-coat unit) 114, a drawing unit 116, a dryer unit 118, a fixing unit 120, and a delivery unit 122. The ink-jet recording device 100 is a single pass type ink-jet recording device that forms a desired color image on a recording medium 124 (for convenience, it may be called a "sheet") held on a drum (drawing drum 170) of the drawing unit 116 by landing a plurality of color ink drops from ink-jet heads 172M, 172K, 172C, and 172Y, and particularly a drop-on demand type image forming device which adopts a two-liquid reaction (coagulation) method that performs imaging on the recording medium 124 through granting a processing solution (here, coagulation processing solution) on the recording medium 124 before landing the ink droplet and reacting the processing solution and the ink liquid.

Feed Unit

In the feed unit 112, the recording medium 124 that is a sheet is laminated, and the recording medium 124 is fed from a feed tray 150 of the feed unit 112 to the processing solution grant unit 114 sheet by sheet. In this embodiment, a sheet (cut-sheet) is used as the recording medium 124. It is also possible to cut a continuous sheet (roll sheet) with a necessary size to feed the cut sheet.

Processing Solution Grant Unit

The processing solution grant unit 114 is a tool that grants the processing solution on the recording surface of the recording medium 124. The processing solution includes a color material coagulant that coagulates a color material (in this embodiment, pigment) of the ink that is granted to the drawing unit 116, and through a contact between the processing solution and the ink, separation of the color material from the solvent in the ink is promoted.

The processing solution grant unit 114 includes a feeding cylinder 152, a processing solution drum (also called a "pre-coat cylinder") 154, and a processing solution application device 156. The processing solution drum 154 is provided with a nail-shaped holding unit (gripper) 155 formed on the circumference thereof, and by inserting the recording medium 124 between the nail of the holding unit 155 and the peripheral surface of the processing solution drum 154, the front end of the recording medium 124 can be held. The processing solution drum 154 may have an absorption hole formed on the circumference thereof, and may be connected to an absorption unit absorbing from the absorption port. Through this, the recording medium 124 becomes in close contact with the peripheral surface of the processing solution drum 154.

The processing solution application device 156 includes a processing solution container storing the processing solution, an annex roller (measurement roller) of which a part is immersed in the processing solution stored in the processing solution container, and a rubber roller that is in press contact with the annex roller and the recording medium 124 on the processing solution drum 154 to transfer the processing solution after the measurement to the recording medium 124. In this embodiment, the configuration that adopts an application method by a roller is exemplified. However, the configuration of the processing solution application device 156 is not limited thereto, and it is also possible to adopt various methods such as a spray method and an ink-jet method.

The recording medium 124, to which the processing solution is granted through the processing solution grant unit 114, is delivered from the processing solution drum 154 to the drawing drum 170 of the drawing unit 116 through a medium transport unit 126.

Drawing Unit

The drawing unit 116 includes a drawing drum (also called a "drawing cylinder" or "jetting cylinder") 170, a paper weight roller 174, and ink-jet heads 172M, 172K, 172C, and 172Y. As the respective color ink-jet heads 172M, 172K, 172C, and 172Y and their control device, the configurations of the print head 50 and the head control unit 60 illustrated in FIG. 5 are adopted.

In the same manner as the processing solution drum 154, the drawing drum 170 is provided with a nail-shaped holding unit (gripper) 171 on the peripheral surface. On the peripheral surface of the drawing drum 170, a plurality of absorption holes (not illustrated) are formed with a predetermined pattern, and by absorbing air from the absorption holes, the recording medium 124 is absorbed and held on the peripheral surface of the drawing drum 170. Further, the configuration that absorbs and holds the recording medium 124 is not limited to the configuration using negative pressure absorption, but a configuration using electrostatic absorption may be adopted.

The ink-jet heads 172M, 172K, 172C, and 172Y are full-line ink-jet types recording heads having a length that corresponds to the maximum width of the image forming area in the recording medium 124, and on the ink discharge surface, a nozzle line (two-dimensionally arranged nozzles), in which a plurality of nozzles for ink discharge are arranged, is formed over the whole amplitude of the image forming area. The respective ink-jet heads 172M, 172K, 172C, and 172Y are installed to extend in the direction that is orthogonal to the transport direction of the recording medium 124 (rotating direction of the drawing drum 170).

In the respective ink-jet heads 172M, 172K, 172C, and 172Y, corresponding color ink cassettes (ink cartridges) are installed. Ink droplets are discharged from the ink-jet heads 172M, 172K, 172C, and 172Y to the recording surface of the recording medium 124 that is held on the peripheral surface of the drawing drum 170.

Through this, ink becomes in contact with the processing solution that is granted to the recording surface in advance, the color material (pigment) that disperses in ink is coagulated, and the color material coagulate is formed. As an example of reaction of the ink and the processing solution, in this embodiment, acid is contained in the processing solution, and using the mechanism that destroys color material dispersion by PH down and coagulates the dispersed color materials, color material blurring, mixed colors between the respective color ink, and landing interference by the solution union during the landing of the ink drops can be avoided. Through this, color material flow on the recording medium 124 is prevented, and an image is formed on the recording surface of the recording medium 124.

The landing timing of the respective ink-jet heads 172M, 172K, 172C, and 172Y is synchronized with an encoder (not illustrated in FIG. 6, reference numeral 294 in FIG. 10) that is arranged on the drawing drum 170 to detect the rotating speed. Based on the detection signal of the encoder, the discharge trigger signal (pixel trigger) starts. Through this, the landing position can be determined with high accuracy. Further, by learning the speed change due to the fluctuation of the drawing drum 170 in advance and correcting the landing timing obtained by the encoder, the landing unevenness can be reduced without depending on the fluctuation of the drawing drum 170, the accuracy of the rotating shaft, and the speed of the circumference of the drawing drum 170. Further, the maintenance operation of the respective ink-jet heads 172M, 172K, 172C, and 172Y, such as cleaning of the nozzle surface and thickening ink discharge, can be performed by evacuating the head units from the drawing drum 170.

In this embodiment, the configuration of standard colors (four colors) of CMYK is exemplified. However, the combination of ink colors or the number of colors is not limited to this embodiment, and if necessary, light shade ink, strong ink, and special color ink may be additionally provided. For example, an ink-jet head that discharges light field ink such as light cyan or light magenta may be additionally provided, and the color head arrangement order is not specially limited.

The recording medium 124 on which an image is formed by the drawing unit 116 is delivered from the drawing drum 170 to the dryer drum 176 of the dryer unit 118 through the medium transport unit 128.

Dryer Unit

The dryer unit 118 is a tool that dries water included in a solvent that is separated by the color material coagulation action, and includes a dryer drum (also called a "dryer cylinder") 176 and a solvent dryer device 178. In the same manner as the processing solution drum 154, the dryer drum 176 is provided with a nail-shaped holding unit (gripper) 177 formed on the peripheral surface thereof, and by this holding unit 177, the front end of the recording medium 124 can be held.

The solvent dryer device 178 is arranged in a position that faces the peripheral surface of the dryer drum 176, and includes a plurality of halogen heaters 180 and warm air blowing nozzles 182 arranged between the respective halogen heaters 180. By properly adjusting the temperature and air quantity of the warm air that is blown from respective warm air blowing nozzles 182 to the recording medium 124 and the temperature of respective halogen heaters 180, various drying conditions can be realized. The recording medium 124 that is dried by the dryer unit 118 is delivered from the dryer drum 176 to the fixing drum 184 of the fixing unit 120 through the medium transport unit 130.

Fixing Unit

The fixing unit 120 includes a fixing drum (also called a "fixing cylinder") 184, a halogen heater 186, a fixing roller 188, and an inline sensor 190. In the same manner as the processing solution drum 154, the fixing drum 184 is provided with a nail-shaped holding unit (gripper) 185 formed on the peripheral surface thereof, and by this holding unit 185, the front end of the recording medium 124 can be held.

By the rotation of the fixing drum 184, the recording medium 124 is transported in a state where the recording surface is toward the outside, and with respect to the recording surface, preliminary heating by the halogen heater 186, fixing process by the fixing roller 188, and checking by the inline sensor 190 are performed.

The inline sensor 190 is a reading unit for measuring a poor discharge check pattern, the density of an image, and the defect of an image with respect to the image (including a test pattern and the like) recorded on the recording medium 124, and adopts a CCD line sensor and the like.

By the fixing unit 120 configured as above, latex particles in a thin image layer formed on the dryer unit 118 is pressingly heated and melted by the fixing roller 188, and thus can be firmly fixed to the recording medium 124.

Further, instead of ink including a high boiling point solvent and polymer fine particles (thermoplastic resin particles), the ink may contain a monomer component of which polymerization hardening is possible by ultraviolet rays (UV) exposure. In this case, the ink-jet recording device 100 has a UV exposure unit that exposes the ink on the recording medium 124 with UV rays instead of a heat pressure fixing unit by a heating roller (fixing roller 188). As described above, in the case of using the ink that includes active rays curable resin such as UV curable resin, means for irradiating active rays, such as a UV lamp or ultraviolet LD (laser diode) array is prepared instead of the fixing roller 188 of the heating fixation.

Delivery Unit

A delivery unit 122 is provided to follow the fixing unit 120. The delivery unit 122 has a discharge tray 192, and between the discharge tray 192 and the fixing drum 184 of the fixing unit 120, a guide cylinder 194, a transport belt 196, and a stretch roller 198 are provided in contact with the discharge tray 192 and the fixing drum 184. The recording medium 124 is sent to the transport belt 196 by the guide cylinder 194, and is discharged to the discharge tray 192. Although the details of a paper transport mechanism by the transport belt 196 are not illustrated, the front end of the recording medium 124 after printing is held by the gripper of a bar (not illustrated) that is carried between endless transport belts 196, and is carried above the discharge tray 192 by the rotation of the transport belt 196.

Although not shown in FIG. 6, the ink-jet recording device 100 according to this embodiment includes an ink storage/loading unit supplying ink to the ink-jet heads 172M, 172K, 172C, and 172Y, means for supplying the processing solution to the processing solution grant unit 114, a head maintenance unit performing cleaning (wiping of the nozzle surface, purging, nozzle absorption, and the like) of the ink-jet heads 172M, 172K, 172C, and 172Y, a position detection sensor detecting the position of the recording medium 124 on the paper transport path, and a temperature sensor detecting the temperature of respective device parts.

Configuration Example of Ink-Jet Head

Next, the structure of the ink-jet head will be described. Since the structures of the ink-jet heads 172M, 172K, 172C, and 172Y corresponding to the respective colors are common, the reference numeral 250 denotes the head as a representative.

Figure 7A:
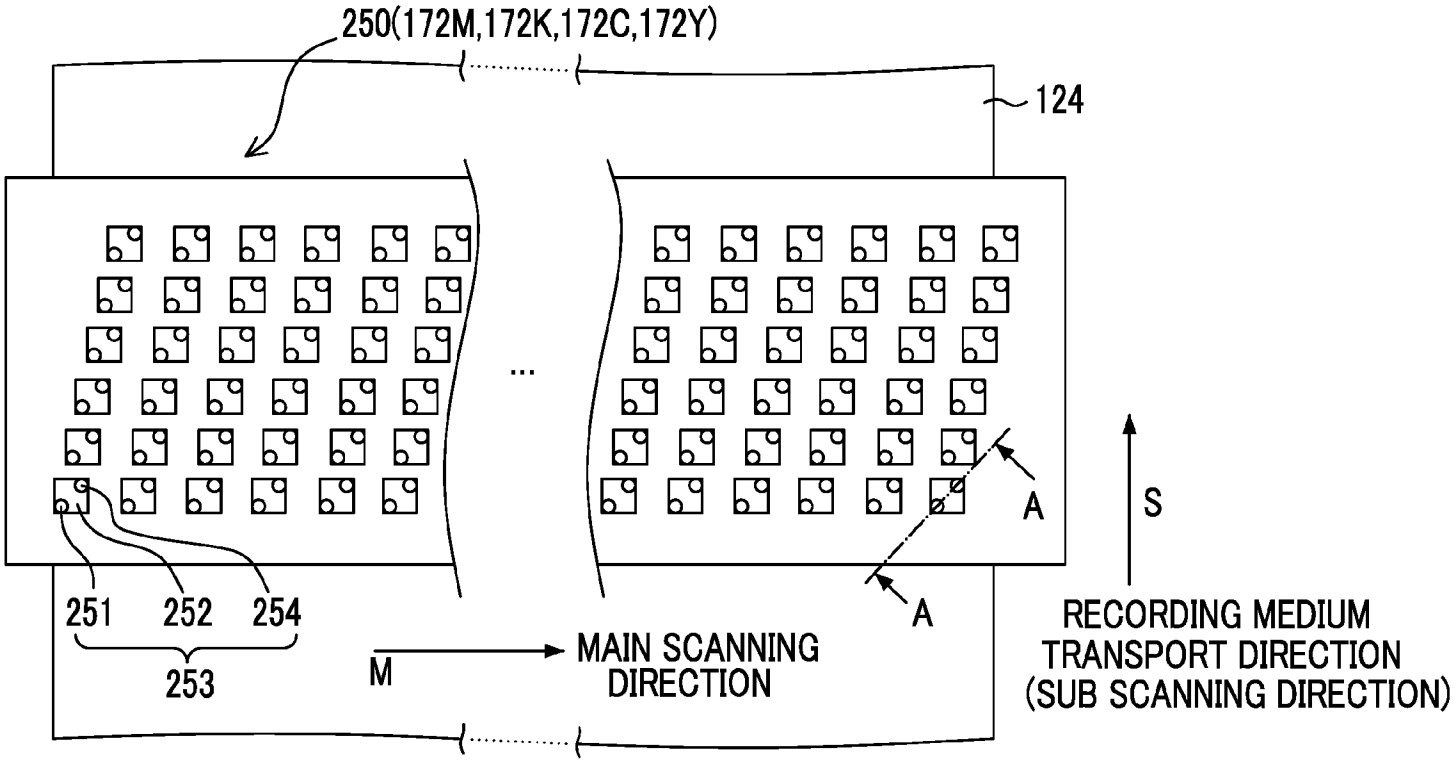
FIGS. 7A and 7B are planar perspective views illustrating the configuration example of an ink-jet head.
Figure 7B:
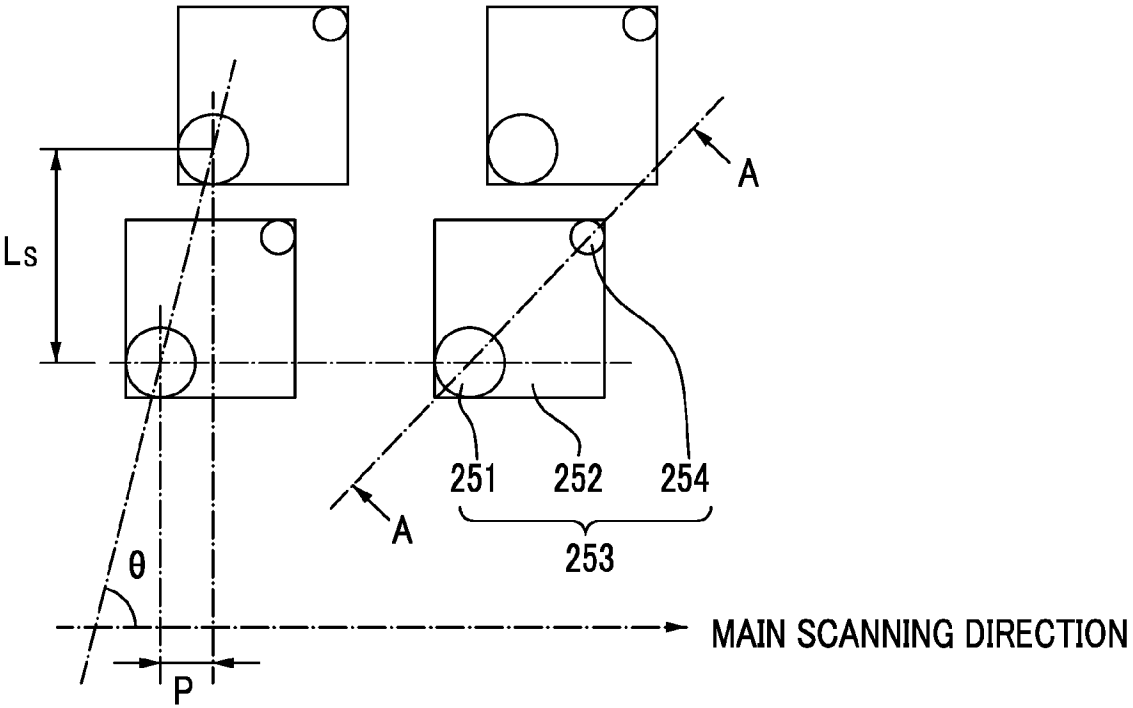
Figure 8A:
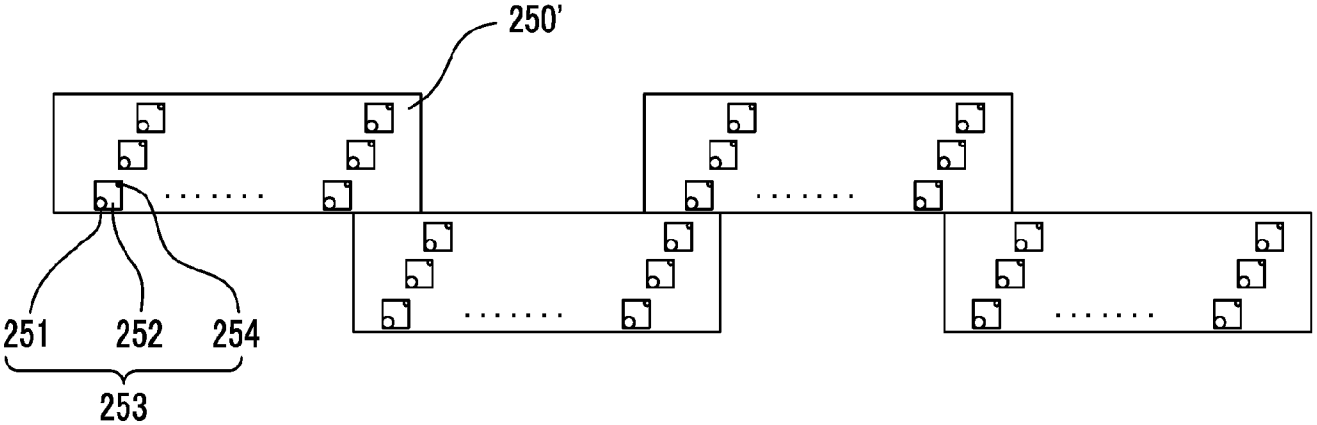
FIGS. 8A and 8B are planar perspective views illustrating another configuration example of the head.
Figure 8B:
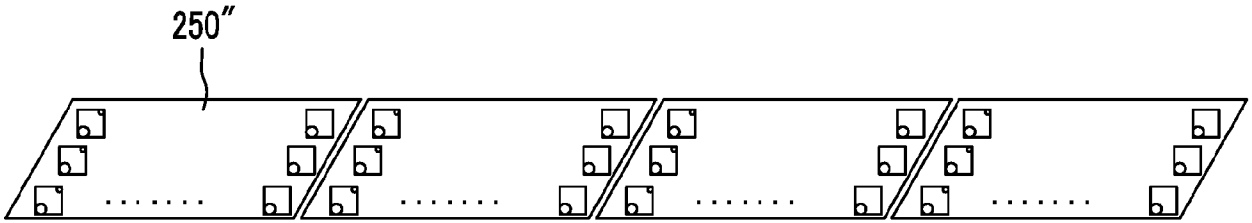
Figure 9:
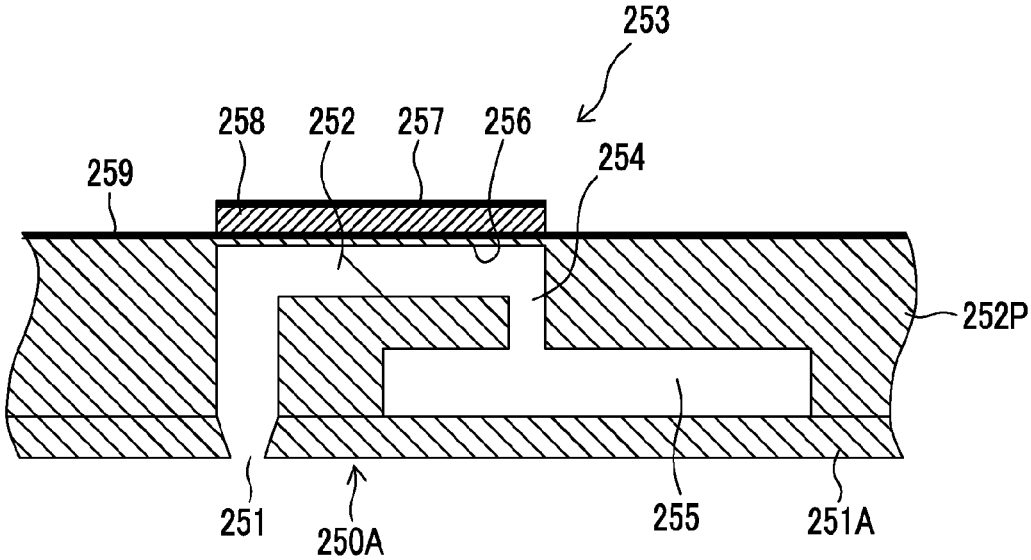
FIG. 9 is a cross-sectional view taken along line A-A of FIGS. 7A and 7B.

FIG. 7A is a plane perspective view illustrating an example of the structure of the head 250, and FIG. 7B is an enlarged view of a part thereof. FIGS. 8A and 8B are views illustrating an arrangement example of a plurality of head modules that constitute the head 250. FIG. 9 is a cross-sectional view (taken along line A-A of FIGS. 7A and 7B) illustrating a three-dimensional configuration of a droplet discharge element for one channel (ink chamber unit corresponding to one nozzle 251) that becomes the recording element unit (discharge element unit).

As illustrated in FIGS. 7A and 7B, the head 250 according to this embodiment has a structure in which a plurality of ink chamber units (droplet discharge elements) 253 that are composed of nozzles 251 that are ink discharge ports and pressure chambers 252 that correspond to the respective nozzles 251 are two-dimensionally arranged in the form of a matrix. Through this, densification of the actual nozzle intervals (projection nozzle pitch) that are projected (orthogonally projected) to line up along the head length direction (direction to be orthogonal to the paper transport direction) is achieved.

In order to configure a nozzle line having a length that is equal to or longer than the overall width Wm of the drawing area of the recording medium 124 in a direction (direction indicated by an arrow M; corresponding to the "second direction") that is substantially orthogonal to the transfer direction (direction indicated by an arrow S; corresponding to the "first direction") of the recording medium 124, for example, as shown in FIG. 8A, a ling line-type head is configured by arranging short head modules 250', in which a plurality of nozzles 251 are two-dimensionally arranged, in a zigzag shape. Further, as shown in FIG. 8B, it is also possible to arrange in line and connect the head modules 250". The head modules 250' or 250" shown in FIGS. 8A and 8B correspond to the head modules 52*a* and 52*b* illustrated in FIG. 5.

A full-line type print head for single pass printing is not limited to a case where the overall surface of the recording medium 124 is in a drawing range, and in the case where a part of the surface of the recording medium 124 becomes the drawing area (for example, in the case where a non-drawing area (margin) is provided around the paper), it is sufficient if a nozzle line that is necessary for drawing in a predetermined drawing area is formed.

The pressure chambers 252 provided to correspond to the respective nozzle 251 have planes that are substantially in a square shape (see FIGS. 7A and 7B), an outlet to the nozzle 251 is provided on one side of both corners on a diagonal line, and an inlet (supply port) 254 of the ink is provided on the other side. Further, the shape of the pressure chamber 252 is not limited to this embodiment, but may have various plane shapes, such as rectangle (lozenge, tetragon, or the like), pentagon, hexagon, other polygons, circle, and ellipse.

As shown in FIG. 9, the head 250 (head modules 250' and 250") has a structure in which a nozzle plate 251A, on which nozzles 251 are formed, and a duct board 252P, on which the pressure chamber 252 or a flow path such as a common path 255 are formed, are laminated and joined. On the nozzle plate 251A, a nozzle surface (ink discharge surface) 250A of the head 250 is formed, and a plurality of nozzles 251 that communicate with the respective pressure chamber 252 are two-dimensionally formed.

The duct plate 252P is a duct forming member that forms a side wall of the pressure chamber 252 and a supply port 254 as a diaphragm portion (narrowest) of the individual supply path that introduces ink from the common path 255 to the pressure chamber 252. Further, although simply illustrated in FIG. 9 for convenience in explanation, the duct plate 252P has a structure in which one sheet or plural sheets of substrates are laminated.

The nozzle plate 251A and the duct plate 252P are made of a silicon material, and can be processed in a necessary shape by a semiconductor manufacturing process.

The common path 255 communicates with an ink tank (not illustrated) that is an ink supply source, and the ink that is supplied from the ink tank is supplied to the respective pressure chamber 252 through the common path 255.

To a vibrating plate 256 that forms a surface of a part of the pressure chamber 252 (upper surface in FIG. 9), a piezoelectric actuator (piezoelectric element) 258 having an individual electrode 257 is joined. The vibrating plate 256 according to this embodiment is made of silicon (Si) with a nickel (Ni) conductive layer that functions as a common electrode 259 corresponding to a lower electrode of the piezoelectric actuator 258, and also serves as a common electrode of the piezoelectric actuator 258 arranged to correspond to the pressure chamber 252. Further, the vibrating plate may be formed of a non-conductive material such as resin, and in this case, a common electrode layer made of a conductive material such as metal is formed on the surface of the vibrating plate member. Further, a vibrating plate that serves as a common electrode made of metal (conductive material) such as stainless steel (SUS) may be configured.

By applying the driving voltage to the individual electrode 257, the piezoelectric actuator 258 is deformed to change the volume of the pressure chamber 252, and thus the ink is discharged from the nozzle 251 due to the pressure change. When the piezoelectric actuator 258 is returned to the original state after the ink discharge, new ink from the common path 255 refills in the pressure chamber 252 through a supply port 254.

As illustrated in FIG. 7B, by arranging a plurality of ink chamber units 253 having the above-described structure in a lattice form in a constant arrangement pattern along a row direction that follows a main scanning direction and a column direction having a slope with a predetermined angle 8, which is not orthogonal to the main scanning direction, high-density nozzle head according to this embodiment is realized. In such as matrix arrangement, if it is assumed that the interval between adjacent nozzles in a sub-scanning direction is Ls, the substantially respective nozzles 251 can be equivalently handled as if they were arranged in a linear shape with a constant pitch of $P=Ls/\tan\theta$ with respect to the main scanning direction.

The arrangement shape of the nozzles 251 in the head 250 according to an embodiment of the present invention is not limited to the illustrated example, but various nozzle arrangement structures may be adopted. For example, instead of the matrix arrangement illustrated in FIGS. 7A and 7B, it is possible to provide a nozzle arrangement of "V" shape or a nozzle arrangement of a broken line shape such as zigzag shape ("W" shape) that considers the "V"-shaped arrangement as a repetition unit.

Further, the means for generating the pressure (discharge energy) for discharging the droplets from the respective nozzle in the ink-jet head is not limited to the piezoelectric actuator (piezoelectric element), but may adopt various pressure generation elements (discharge energy generation elements) such as an electrostatic actuator and the like. According to the discharge method of the head, a corresponding energy generation element is provided in the flow path structure.

Explanation of Control System

Figure 10:
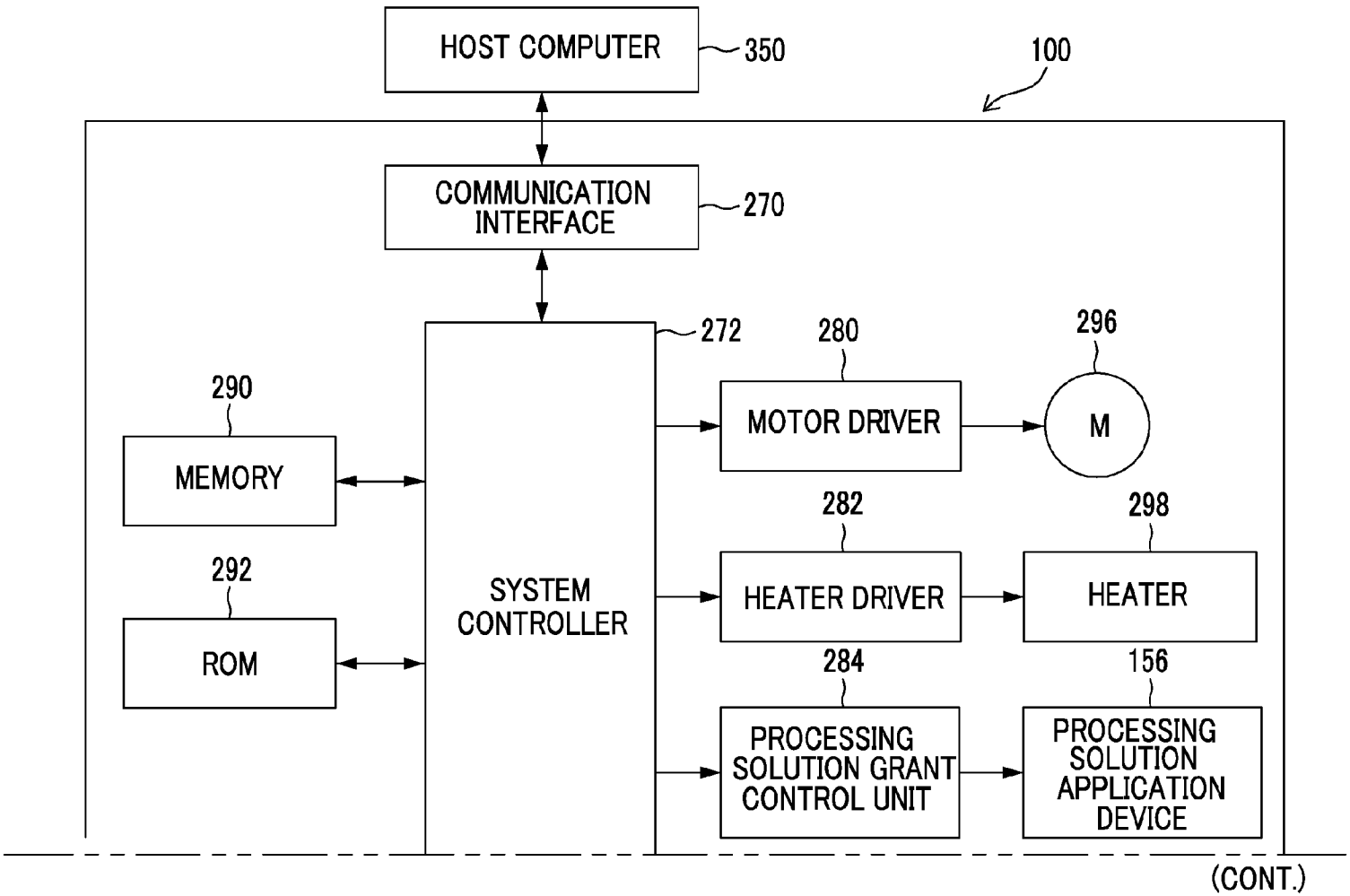
FIG. 10 is a main part block diagram illustrating the system configuration of an ink-jet recording device.

FIG. 10 is a main part block diagram illustrating the system configuration of an ink-jet recording device 100. The ink-jet recording device 100 includes a communication interface 270, a system controller 272, a print control unit 274, an image buffer memory 276, a head driver 278, a motor driver 280, a heater driver 282, a processing solution grant control unit 284, a dryer control unit 286, a fixing control unit 288, a memory 290, a ROM 292, and encoder 294.

The communication interface 270 is an interface unit that receives image data that is sent from a host computer 350. As the communication interface unit 270, a serial interface such as USB (Universal Serial Bus), IEEE1394, and Ethernet (registered mark), or a parallel interface such as Centronics may be adopted. In this case, a buffer memory (not illustrated) to speed up communication may be installed. Image data output from the host computer 350 is transferred to the ink-jet recording device 100 through the communication interface 270, and is once stored in the memory 290.

The memory 290 is a storage unit for once storing the image input through the communication interface 270, and data read/write is performed through the system controller 272. The memory 290 is not limited to a memory composed of a semiconductor device, but a magnetic medium such as a hard disc may be used as the memory 290.

The system controller 272 is composed of a central processing unit (CPU) and peripheral circuits thereof, and functions not only as a control device controlling the whole of the ink-jet recording device 100 according to a predetermined program but also as an operation device performing various operations. That is, the system controller 272 performs communication control with the host computer 350 and read/write control of the memory 290 through control of respective units, such as the communication interface 270, the print control unit 274, the motor driver 280, the heater driver 282, and the processing solution grant control unit 284, and generates a control signal for controlling a motor 296 or a heater 298 of a transport system.

In the ROM 292, programs executed by the CPU of the system controller 272 and various data that are required for control are stored. The ROM 292 may be a non-rewritable storage unit or a rewritable storage unit such as an EEPROM. The memory 290 is used not only as a temporary storage area of the image data but also as a program development area and an operation working area of the CPU.

The motor driver 280 is a driver that drives the motor 296 according to an instruction from the system controller 272. In FIG. 10, the reference numeral 296 is illustrated as a representative of various motors arranged in respective units of the device. For example, the motor 296 illustrated in FIG. 10 includes motors that rotate the feed cylinder 152 in FIG. 6, the processing solution drum 154, the drawing drum 170, the dryer drum 176, the fixing drum 184, and the guide cylinder 194, a motor that drives a pump for absorbing the negative pressure from the absorption port of the drawing drum 170, and a motor of an evacuation mechanism that moves the head units of the ink-jet heads 172M, 172K, 172C, and 172Y to the maintenance area except for the drawing drum 170.

The heater driver 282 is a driver that drives the heater 298 according to an instruction from the system controller 272. In FIG. 10, the reference numeral 298 is illustrated as a representative of various heaters arranged in respective units of the device. For example, the heater 298 illustrated in FIG. 10 includes a pre-heater (not illustrated) or the like that heats the recording medium 124 in the feed unit 112 in appropriate temperature in advance.

The print control unit 274 is a control unit which has a signal processing function of performing various processes and correction for generating a print control signal from the image data in the memory 290 under the control of the system controller 272, and supplies generated print data (dot data) to the head driver 278.

The dot data is generated through a color conversion process and a half tone process that are generally performed with respect to multi-gradation image data. The color conversion process is the process for converting image data (for example, 8-bit image data with respect to RGB colors) that is expressed by sRGB or the like into color data (in this embodiment, color data of KCMY) of colors of ink that is used in the ink-jet recording device 100.

The half tone process is a process that converts the color data of the respective colors generated by the color conversion process into dot data of the respective colors (in this embodiment, dot data of KCMY) through an error diffusion method or a threshold matrix process.

The print control unit 274 performs a necessary signal process, and controls the discharge amount of ink drops of the head 250 or the discharge timing through the head driver 278. Through this, based on the obtained dot data, a desired dot size or a dot arrangement is realized. Here, the dot data is used as the "nozzle selection signal".

The print control unit 274 may be provided with an image buffer memory (not illustrated), and image data or parameter data is temporarily stored in the image buffer memory during the processing of the image data in the print control unit 274. Further, it is also possible to integrate the print control unit 274 and the system controller 272 into one processor.

A flow of processing from the image inputting to the printing output will now be outlined. The image data to be printed is input from outside through the communication interface 270 and may be stored in the memory 290. In this stage, for example, RGB image data is stored in the memory 290. In the ink-jet recording device 100, in order to form an image of pseudo continuous gradation to the eyes of a person through changing the landing density or dot size of a fine dot by the ink (color material), it is necessary to convert an input digital image into a dot pattern whereby the gradation (light and shade of an image) of the digital image can reappear as faithfully as possible. Because of this, the original image (RGB) data which has been stored in the memory 290 is sent to the print control unit 274 through the system controller 272, and is converted into dot data for each ink color by the half tone process using the threshold matrix or the error diffusion method in the print control unit 274. That is, the print control unit 274 converts the input RGB image data into dot data of four colors of KCMY. Through this, the dot data generated by the print control unit 274 can be stored in the image buffer memory (not illustrated).

The head driver 278 outputs a driving signal for driving the actuators corresponding to the respective nozzles of the head 250 based on the print data (that is, dot data stored in the image buffer memory 276) that is given from the print control unit 274. The head driver 278 may include a feedback control system for constantly maintaining the driving conditions of the head.

By adding the driving signal output from the head driver 278 to the head 250, ink is discharged from the corresponding nozzle. By controlling the ink discharge from the head 250 while transporting the recording medium 124 at a predetermined speed, an image is formed on the recording medium 124. Further, the ink-jet recording device 100 according to this embodiment adopts a driving method that discharges the ink from the nozzle 251 corresponding to the piezoelectric actuator 258 by newly changing the ON/OFF state of the switch element (not illustrated) that is connected to the individual electrodes of each piezoelectric actuator 258 according to the discharge timing of the piezoelectric actuator 258 through applying a common driving power waveform signal in the unit of a module with respect to the piezoelectric actuator 258 of the head 250 (head module).

The portion of the head driver 278 and the print control unit 274 (having a built-in image buffer memory) corresponds to the head control unit 60 illustrated in FIG. 5. Further, the system controller 272 of FIG. 10 corresponds to the upper data control unit 80 illustrated in FIG. 5.

The processing solution grant control unit 284 controls the operation of the processing solution application device 156 (see FIG. 6) according to the instruction from the system controller 272. The dryer control unit 286 controls the operation of the solvent dryer device 178 (see FIG. 6) according to the instruction from the system controller 272.

The fixing control unit 288 controls the operation of the fixation pressing unit 299 that is composed of the halogen heater 186 or the fixing roller 188 (see FIG. 6) of the fixing unit 120 according to the instruction from the system controller 272.

As illustrated in FIG. 6, the inline sensor 190 is a block that includes an image sensor, which reads the image printed on the recording medium 124, detects the printing situations (existence/nonexistence of discharge, unevenness of landing, optical concentration, and the like) through performing necessary signal processing, and provides the result of the detection to the system controller 272 and the print control unit 274.

The print control unit 274 performs various corrections (non-discharge correction, concentration correction, and the like) with respect to the head 250 based on the information that can be obtained from the inline sensor 190, and controls the preliminary discharge, absorption, and cleaning operation (nozzle recovery operation) such as wiping as needed.

Modified Example of Device Configuration

In the above-described embodiment, the ink-jet recording device having a method (direct recording method) of forming an image by directly landing the ink drops onto the recording medium 124 has been described. However, the application range of the present invention is not limited thereto, but the present invention can be applied to the medium transfer type image forming device which first forms an image (primary image) on a medium transcript and then transfers the image to a recording sheet through a transfer unit to perform the final imaging.

Regarding Means for Relatively Moving Head and Sheet

In the above-described embodiment, the configuration that transports the recording medium with respect to the stopped head has been exemplified. However, according to the embodiment of the present invention, it is also possible to move the head with respect to the stopped recording medium (drawing medium). Further, although the full-line type recording head of the single pass method is typically arranged along the direction that is orthogonal to the recording medium transfer method (transport direction), it is also possible to arrange the head along the direction having a slope with a predetermined angle with respect to the direction that is orthogonal to the transport direction.

In the above-described embodiment, the ink-jet recording device (single pass type image forming device that completes the image by one sub-scanning) using a page wide full-line type heads having a nozzle line with a length that corresponds to the whole width of the recording medium has been described. However, the application range of the present invention is not limited thereto, but the present invention can also be applied to an ink-jet recording device that performs image recording by multiple times head scanning while moving the short recording heads such as serial type (shuttle scan type) heads.

Regarding Recording Medium

The "recording medium" is the generic name of the medium on which dot is recorded by droplets discharged from the liquid discharge head, and includes those that are called by several wordings, such as a printing medium, recorded medium, image forming medium, television medium, and discharged medium. In the embodiment of the present invention, the material or the shape of the recording medium is not specially limited, but various media are applicable, such as a continuous sheet, a cut sheet, a seal sheet, a resin sheet such as an OHP sheet, a film, cloth, nonwoven fabric, a printed board on which a wiring pattern or the like is formed, a rubber sheet, and other media regardless of the material or the shape thereof.

Regarding Application Example of the Present Invention

In the above-described embodiment, the application to the ink-jet recording device for printing graphics has been described. However, the application range of the present invention is not limited thereto. For example, the present invention can widely be applied to a wiring drawing device that draws wiring patterns of an electronic circuit, various device manufacturing devices, a resist printing device using a resin solution as a functional solution for discharging, a color filter manufacturing device, a fine structure forming device for forming a fine structure using a material for material deposition, a liquid discharge apparatus that draws various shapes or patterns using the liquid functional material, and an ink-jet system.

The present invention is not limited to the above-described embodiments, and many modifications can be made by a person having ordinary skill in the pertinent art that the present invention pertains in the technical thought of the present invention.

Various Aspects of Disclosed Invention

As can be understood from the above detailed description of the embodiments, the specification and the drawings include disclosure of various technical thoughts including the invention described hereinafter.

(First aspect): A device for driving a liquid discharge head, which discharges droplets from a nozzle of a liquid discharge head by generating a driving signal for operating a discharge energy generation element that is provided in response to the nozzle of the liquid discharge head and supplying the driving signal to the discharge energy generation element, including: a basic driving waveform generation unit generating a basic driving waveform including a plurality of jet pulses and a non-jet pulse just before the last jet pulse of the plurality of jet pulses in one recording period; and a driving signal generation unit removing a part of the pulses from the basic driving waveform by maintaining at least the last jet pulse and generating a driving signal that is applied to the discharge energy generation element, wherein the driving signal generation unit is provided with a waveform selection unit which can selectively generate a first driving signal that is configured by maintaining the last jet pulse of the plurality of jet pulses in the basic driving waveform and including the non-jet pulse just before the last jet pulse, and a second driving signal that is configured by maintaining the last jet pulse and at least another jet pulse of the plurality of jet pulses in the basic driving waveform and removing at least the non-jet pulse.

According to this aspect, the speed difference between the speed of the droplet that is discharged by the application of the first driving signal and the speed of the droplet that is discharged by the application of the second driving signal can be reduced. Through this, the unevenness of the landing position of the droplet due to the difference between the droplet sizes can be suppressed, and thus high-quality image forming becomes possible. Further, according to this aspect, the length of the driving waveform that that is necessary to record one dot can be shortened, and thus high-frequency discharge becomes possible.

(Second aspect): In the device for driving a liquid discharge head according to the first aspect, the interval between the non-jet pulse and the last jet pulse is in a range that is equal to or larger than ¼ and equal to or smaller than ¾ of a resonance period Tc of the liquid discharge head.

The interval between the non-jet pulse and the last jet pulse is determined so that the speed difference between the discharge speed of the droplet that is discharged by the application of the first driving signal and the discharge speed of the droplet that is discharged by the application of the second driving signal becomes within a permissible range of a picture quality (for example, within 5% error).

(Third aspect): In the device for driving a liquid discharge head according to the first or second aspect, a voltage of the non-jet pulse is in a range that is equal to or larger than 10% and equal to or smaller than 50% of a voltage of the last jet pulse.

The voltage ratio of the non-jet pulse to the last jet pulse is determined so that the speed difference between the discharge speed of the droplet that is discharged by the application of the first driving signal and the discharge speed of the droplet that is discharged by the application of the second driving signal becomes within the permissible range of a picture quality (for example, within ±2.5% error).

(Fourth aspect): In the device for driving a liquid discharge head according to any one of the first to third aspects, the droplet quantity discharged by application of the first driving signal is smaller than the droplet quantity discharged by application of the second driving signal.

By the number of jet pulses included in the driving signal that is applied to the discharge energy generation device, the droplet quantity for forming one dot can be changed. As the number of jet pulses becomes larger, the number of jets becomes larger to increase the discharged droplet quantity.

(Fifth aspect): In the device for driving a liquid discharge head according to any one of the first to fourth aspects, the driving signal generation unit generates two or more kinds of driving signals that correspond to two or more kinds of droplet discharge operations having different droplet quantities according to the number of jet pulses extracted from the basic driving waveform, and the droplet quantity discharged by application of the first driving signal is the smallest droplet quantity among the two or more kinds of droplet quantities.

In the case of the configuration that can discharge two or more kinds of droplets having different droplet quantities, the first driving signal that is obtained by combining the non-jet pulse and the last jet pulse can be used as the driving signal that is applied during the discharge of the minimum droplet quantity.

(Sixth aspect): In the device for driving a liquid discharge head according to any one of the first to fifth aspects, the last jet pulse among the plurality of jet pulses has the largest voltage amplitude.

According to this aspect, the droplet speed of the droplet (last droplet) that is discharged by the application of the last jet pulse becomes fastest in comparison to the droplet speed of other droplets antecedently discharged. Through this, the last discharge droplet chases another preceding droplet during their flight, and these plural droplets are united to form one droplet.

(Seventh aspect): In the device for driving a liquid discharge head according to the sixth aspect, the plurality of jet pulses in the basic driving waveform are configured to have voltages that gradually increase from the front jet pulse to the last jet pulse.

According to this configuration, by selecting the jet pulse that is used for discharge from behind of the plurality of jet pulses in the basic driving waveform, plural kinds of droplets having different droplet quantities can be discharged.

(Eighth aspect): In the device for driving a liquid discharge head according to any one of the first to seventh aspects, the preceding droplet which is discharged by application of another jet pulse that precedes the last jet pulse and the last droplet which is discharged by the last jet pulse are joined during their flight in the second driving signal.

It is preferable to determine the arrangement of each pulse so that the main droplet, which is formed through uniting the plural droplets that are consecutively discharged in one recording period, is landed on the medium in the second driving signal.

(Ninth aspect): The device for driving a liquid discharge head according to any one of the first to eighth aspects, further including: a waveform data storage unit storing digital waveform data that indicates the basic driving waveform; and a D/A converter converting the digital waveform data read from the waveform data storage unit into an analog signal, wherein the waveform selection unit includes a switch unit controlling timing to apply a part of a voltage signal of the basic driving waveform that is generated through the D/A converter to the discharge energy generation element.

(Tenth aspect): A method for driving a liquid discharge head, which discharges droplets from a nozzle of a liquid discharge head by generating a driving signal for operating a discharge energy generation element that is provided in response to the nozzle of the liquid discharge head and supplying the driving signal to the discharge energy generation element, including: a basic driving waveform generation step of generating a basic driving waveform including a plurality of jet pulses and a non-jet pulse just before the last jet pulse of the plurality of jet pulses in one recording period; and a driving signal generation step of removing a part of the pulses from the basic driving waveform by maintaining at least the last jet pulse and generating a driving signal that is applied to the discharge energy generation element, wherein the driving signal generation step includes a waveform selection step which can selectively generate a first driving signal that is configured by maintaining the last jet pulse of the plurality of jet pulses in the basic driving waveform and including the non-jet pulse just before the last jet pulse, and a second driving signal that is configured by maintaining the last jet pulse and at least another jet pulse of the plurality of jet pulses in the basic driving waveform and removing at least the non-jet pulse.

(Eleventh aspect): A liquid discharge apparatus including: a liquid discharge head including a nozzle for discharging droplets, a pressure chamber communicating with the nozzle, and a discharge energy generation element provided in the pressure chamber; and the device for driving the liquid discharge head according to any one of the first to ninth aspects as the driving device that supplies a driving signal for discharging the droplets from the nozzle of the liquid discharge head to the discharge energy generation element.

The liquid discharge apparatus is realized by combining the device for driving the liquid discharge head according to any one of the first to ninth aspects and the liquid discharge head that operates through receiving a supply of the driving signal from the driving device.

(Twelfth aspect): An ink-jet apparatus including: an ink-jet head as the liquid discharge head including a nozzle for discharging droplets, a pressure chamber communicating with the nozzle, and a discharge energy generation element provided in the pressure chamber; and the device for driving the liquid discharge head according to any one of the first to ninth aspects as the driving device that supplies a driving signal for discharging the droplets from the nozzle of the ink-jet head to the discharge energy generation element.

The ink-jet apparatus is realized by combining the device for driving the liquid discharge head according to any one of the first to ninth aspects and the ink-jet head that operates through receiving a supply of the driving signal from the driving device.

According to this aspect, the ink-jet apparatus with both the high picture quality and the high productivity can be realized.

What is claimed is:

1. A device for driving a liquid discharge head, which discharges droplets from a nozzle of a liquid discharge head by generating a driving signal for operating a discharge energy generation element that is provided in response to the nozzle and supplying the driving signal to the discharge energy generation element, comprising:

a basic driving waveform generation unit generating a basic driving waveform including a plurality of jet pulses and a non-jet pulse just before the last jet pulse of the plurality of jet pulses in one recording period; and a driving signal generation unit removing a part of the pulses from the basic driving waveform by maintaining at least the last jet pulse and generating a driving signal that is applied to the discharge energy generation element, wherein the driving signal generation unit is provided with a waveform selection unit which can selectively generate:

a first driving signal that is configured by maintaining the last jet pulse of the plurality of jet pulses in the basic driving waveform and including the non-jet pulse just before the last jet pulse, and a second driving signal that is configured by maintaining the last jet pulse and at least another jet pulse of the plurality of jet pulses in the basic driving waveform and removing at least the non-jet pulse.

2. The device for driving a liquid discharge head according to claim 1, wherein the interval between the non-jet pulse and the last jet pulse is in a range that is equal to or larger than ¼ and equal to or smaller than ¾ of a resonance period Tc of the liquid discharge head.

3. The device for driving a liquid discharge head according to claim 2, wherein a voltage of the non-jet pulse is in a range that is equal to or larger than 10% and equal to or smaller than 50% of a voltage of the last jet pulse.

4. The device for driving a liquid discharge head according to claim 3, wherein the droplet quantity discharged by application of the first driving signal is smaller than the droplet quantity discharged by application of the second driving signal.

5. The device for driving a liquid discharge head according to claim 3, wherein the driving signal generation unit generates two or more kinds of driving signals that correspond to two or more kinds of droplet discharge operations having different droplet quantities according to the number of jet pulses extracted from the basic driving waveform, and the droplet quantity discharged by application of the first driving signal is the smallest droplet quantity among the two or more kinds of droplet quantities.

6. The device for driving a liquid discharge head according to claim 2, wherein the droplet quantity discharged by application of the first driving signal is smaller than the droplet quantity discharged by application of the second driving signal.

7. The device for driving a liquid discharge head according to claim 2, wherein the driving signal generation unit generates two or more kinds of driving signals that correspond to two or more kinds of droplet discharge operations having different droplet quantities according to the number of jet pulses extracted from the basic driving waveform, and the droplet quantity discharged by application of the first driving signal is the smallest droplet quantity among the two or more kinds of droplet quantities.

8. The device for driving a liquid discharge head according to claim 1, wherein a voltage of the non-jet pulse is in a range that is equal to or larger than 10% and equal to or smaller than 50% of a voltage of the last jet pulse.

9. The device for driving a liquid discharge head according to claim 8, wherein the droplet quantity discharged by application of the first driving signal is smaller than the droplet quantity discharged by application of the second driving signal.

10. The device for driving a liquid discharge head according to claim 8, wherein the driving signal generation unit generates two or more kinds of driving signals that correspond to two or more kinds of droplet discharge operations having different droplet quantities according to the number of jet pulses extracted from the basic driving waveform, and the droplet quantity discharged by application of the first driving signal is the smallest droplet quantity among the two or more kinds of droplet quantities.

11. The device for driving a liquid discharge head according to claim 1, wherein the droplet quantity discharged by application of the first driving signal is smaller than the droplet quantity discharged by application of the second driving signal.

12. The device for driving a liquid discharge head according to claim 11, wherein the driving signal generation unit generates two or more kinds of driving signals that correspond to two or more kinds of droplet discharge operations having different droplet quantities according to the number of jet pulses extracted from the basic driving waveform, and the droplet quantity discharged by application of the first driving signal is the smallest droplet quantity among the two or more kinds of droplet quantities.

13. The device for driving a liquid discharge head according to claim 1, wherein the driving signal generation unit generates two or more kinds of driving signals that correspond to two or more kinds of droplet discharge operations having different droplet quantities according to the number of jet pulses extracted from the basic driving waveform, and the droplet quantity discharged by application of the first driving signal is the smallest droplet quantity among the two or more kinds of droplet quantities.

14. The device for driving a liquid discharge head according to claim 1, wherein the last jet pulse among the plurality of jet pulses has the largest voltage amplitude.

15. The device for driving a liquid discharge head according to claim 14, wherein the plurality of jet pulses in the basic driving waveform are configured to have voltages that gradually increase from the front jet pulse to the last jet pulse.

16. The device for driving a liquid discharge head according to claim 1, wherein the preceding droplet which is discharged by application of another jet pulse that precedes the last jet pulse in the second driving signal and the last droplet which is discharged by the last jet pulse are joined during flight thereof.

17. The device for driving a liquid discharge head according to claim 1, further comprising:

a waveform data storage unit storing digital waveform data that indicates the basic driving waveform; and a D/A converter converting the digital waveform data read from the waveform data storage unit into an analog signal, wherein the waveform selection unit includes a switch unit controlling timing to apply a part of a voltage signal of the basic driving waveform that is generated through the D/A converter to the discharge energy generation element.

18. A method for driving the liquid discharge head according to claim 1, comprising:

a basic driving waveform generation step of generating a basic driving waveform including a plurality of jet pulses and a non-jet pulse just before the last jet pulse of the plurality of jet pulses in one recording period; and a driving signal generation step of removing a part of the pulses from the basic driving waveform by maintaining at least the last jet pulse and generating a driving signal that is applied to the discharge energy generation element, wherein the driving signal generation step includes a waveform selection step which can selectively generate a first driving signal that is configured by maintaining the last jet pulse of the plurality of jet pulses in the basic driving waveform and including the non-jet pulse just before the last jet pulse, and a second driving signal that is configured by maintaining the last jet pulse and at least another jet pulse of the plurality of jet pulses in the basic driving waveform and removing at least the non-jet pulse.

19. A liquid discharge apparatus comprising:

the liquid discharge head including a nozzle for discharging droplets, a pressure chamber communicating with the nozzle, and a discharge energy generation element provided in the pressure chamber; and the device for driving the liquid discharge head according to claim 1 as the driving device that supplies a driving signal for discharging the droplets from the nozzle of the liquid discharge head to the discharge energy generation element.

20. An ink-jet apparatus comprising:

an ink-jet head as the liquid discharge head including a nozzle for discharging droplets, a pressure chamber communicating with the nozzle, and a discharge energy generation element provided in the pressure chamber; and the device for driving the liquid discharge head according to claim 1 as the driving device that supplies a driving signal for discharging the droplets from the nozzle of the ink-jet head to the discharge energy generation element.

* * * * *